US007918673B1

(12) United States Patent
Mimura et al.

(10) Patent No.: US 7,918,673 B1
(45) Date of Patent: Apr. 5, 2011

(54) CONNECTOR ASSEMBLY HAVING SIGNAL AND GROUND TERMINALS

(75) Inventors: Shouichi Mimura, Osaka (JP); Masato Tobinaga, Hyogo (JP); Shinkuro Fujino, Kyoto (JP); Ryuya Yamamoto, Osaka (JP); Masahiro Hosoda, Osaka (JP); Hirotsugu Fusayasu, Kyoto (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/904,164

(22) Filed: Oct. 14, 2010

Related U.S. Application Data

(63) Continuation of application No. PCT/JP2010/002586, filed on Apr. 8, 2010.

(30) Foreign Application Priority Data

Oct. 30, 2009 (JP) ..... 2009-250234

(51) Int. Cl.
*H01R 13/648* (2006.01)

(52) U.S. Cl. ..... 439/101

(58) Field of Classification Search ..... 439/101, 439/108, 55, 65, 496, 497
See application file for complete search history.

(56) References Cited

U.S. PATENT DOCUMENTS

| | | | | |
|---|---|---|---|---|
| 3,696,319 | A * | 10/1972 | Olsson | 439/496 |
| 5,984,698 | A * | 11/1999 | Hirata | 439/101 |
| 6,186,836 | B1 | 2/2001 | Ezawa et al. | |
| 6,264,500 | B1 * | 7/2001 | Kawabe | 439/496 |
| 6,544,048 | B2 * | 4/2003 | Harting et al. | 439/101 |
| 6,638,111 | B1 * | 10/2003 | McDaid et al. | 439/607.09 |
| 7,727,028 | B1 * | 6/2010 | Zhang et al. | 439/660 |
| 2001/0024889 | A1 | 9/2001 | Kayama et al. | |
| 2007/0000974 | A1 | 1/2007 | Kubo | |

FOREIGN PATENT DOCUMENTS

| | | | |
|---|---|---|---|
| JP | H05-031172 | U | 4/1993 |
| JP | 2741865 | B | 1/1998 |
| JP | H10-270125 | A | 10/1998 |
| JP | 2000-021474 | A | 1/2000 |
| JP | 2001-266979 | A | 9/2001 |
| JP | 3333457 | B | 7/2002 |
| JP | 2007-012899 | A | 1/2007 |
| JP | 2007-115707 | A | 5/2007 |
| JP | 2009-009728 | A | 1/2009 |

OTHER PUBLICATIONS

Matsubara, et al., "Receptacle Structure, Printed Wiring Board Structure, and Electronic Device" filed Jul. 16, 2010, U.S. Appl. No. 12/837,517.

Matsubara, et al., "Receptacle, Printed Wiring Board, and Electronic Device" filed Oct. 7, 2010, U.S. Appl. No. 12/936,907.

* cited by examiner

*Primary Examiner* — Chandrika Prasad
(74) *Attorney, Agent, or Firm* — Shinjyu Global IP

(57) ABSTRACT

Each of a pair of signal terminals ($T_{C+}$ and $T_{C-}$) includes a signal terminal link portion ($u_{CON}$) that links a first signal terminal end portion ($u_1$) and a second signal terminal end portion ($u_2$). A ground terminal ($T_{GC}$) includes a ground terminal link portion ($t_{CON}$) that links a first ground terminal end portion ($t_1$) and a second ground terminal end portion ($t_2$). The ground terminal link portion ($t_{CON}$) is wired between the signal terminal link portion ($u_{CON}$) and a mounting surface (11A) from the opposite side of the mounting surface (11A) relative to the signal terminal link portion ($u_{CON}$).

16 Claims, 17 Drawing Sheets

CONNECTOR ASSEMBLY HAVING SIGNAL AND GROUND TERMINALS

CROSS-REFERENCE TO RELATED APPLICATIONS

This application is a continuation application of PCT Patent Application No. PCT/JP2010/002586, which claims priority to Japanese Patent Application No. 2009-250234 filed on Oct. 30, 2009. The entire disclosure of PCT Patent Application No. PCT/JP2010/002586, and Japanese Patent Application No. 2009-250234, is hereby incorporated herein by reference.

BACKGROUND

1. Technical Field

The present invention relates to receptacles and to electronic devices that include a receptacle and a printed wiring board.

2. Description of the Related Art

Techniques in which digital signals are transmitted at high speeds between electronic devices (for example, A/V devices, mobile terminals, and so on) via an interface based on a standard such as HDMI (High-Definition Multimedia Interface)®, USB (Universal Serial Bus), and so on have come into wide use in recent years.

Such interface is configured of a receptacle mounted upon a mounting surface of a printed wiring board installed in the electronic device and a plug that is inserted into an opening portion, which is a plug insertion slot formed on the receptacle. The receptacle includes a terminal insulation plate that fits into the plug, multiple bottom terminals, and multiple top terminals. The terminal insulation plate has a first primary surface provided on the side that faces the mounting surface and a second primary surface provided on the side opposite to the first primary surface. The multiple bottom terminals are connected on the first primary surface and the mounting surface. The multiple top terminals are connected on the second primary surface and the mounting surface.

Here, a method is known in which each bottom terminal is connected on the mounting surface at a location closer to the opening portion than each top terminal (for example, see Patent Citation 1). More specifically, when the printed wiring board is viewed from the mounting surface, one end of each top terminal is connected on a first connection region that is distanced from the opening portion, whereas one end of each bottom terminal is connected on a second connection region that is closer to the opening portion than the first connection region.

Patent Citation 1: Japanese Laid-Open Patent Application 2009-9728A

SUMMARY

However, due to a reduction in the spaces between terminals resulting from a reduction in the overall size, the method disclosed in Patent Citation 1 poses the following problems in terms of the wiring design of the printed wiring board onto which the receptacle is mounted, in the case where the multiple bottom terminals contain a pair of signal terminals and the multiple top terminals contain the ground terminal that corresponds to the pair of signal terminals.

That is, with, for example, a micro-HDMI plug and a micro-HDMI receptacle, there are cases where it is necessary to apply detailed wiring rules to the mounting surface when two wires corresponding to the pair of signal terminals connected to the second connection region are to be passed through on both sides of the ground terminal connected to the first connection region. There is thus a problem in that the cost of manufacturing the receptacle and the electronic device increases.

Meanwhile, when passing two wires corresponding to the pair of signal terminals connected to the second connection region into the printed wiring board, it is necessary to make each wire longer than in the case of passing two wires through on both sides of the ground terminal. For this reason, transmission delay, jitter caused by transmission delay, and so on arises in the transmitted signals, which are the signals transmitted by the respective pairs of signal terminals. As a result, a problem where the quality of the transmitted signals drops occurs in the printed wiring board.

Having been achieved in light of the aforementioned circumstances, it is an object of the present invention to provide a receptacle and an electronic device capable of suppressing an increase in the cost of manufacturing a printed wiring board and a drop in the quality of a transmitted signal in the printed wiring board.

A receptacle according to an aspect of the present invention is a receptacle mounted on a mounting surface of a printed wiring board, and includes: a terminal insulation plate having a first primary surface distanced from the mounting surface and a second primary surface provided on the opposite side of the mounting surface relative to the first primary surface; a pair of signal terminals, each having a first signal terminal end portion connected to the first primary surface, a second signal terminal end portion connected to the mounting surface, and a signal terminal link portion connecting the first signal terminal end portion and the second signal terminal end portion; and a ground terminal including a first ground terminal end portion connected to the second primary surface, a second ground terminal end portion connected to the mounting surface, and a ground terminal link portion connecting the first ground terminal end portion and the second ground terminal end portion, the ground terminal link portion being wired between the signal terminal link portions and the mounting surface from a opposite side of the mounting surface relative to the signal terminal link portion.

According to the present invention, it is possible to provide a receptacle and an electronic device capable of suppressing an increase in the cost of manufacturing a printed wiring board and a drop in the quality of a transmitted signal in the printed wiring board.

DETAILED DESCRIPTION OF THE PREFERRED EMBODIMENTS

Figure 1:
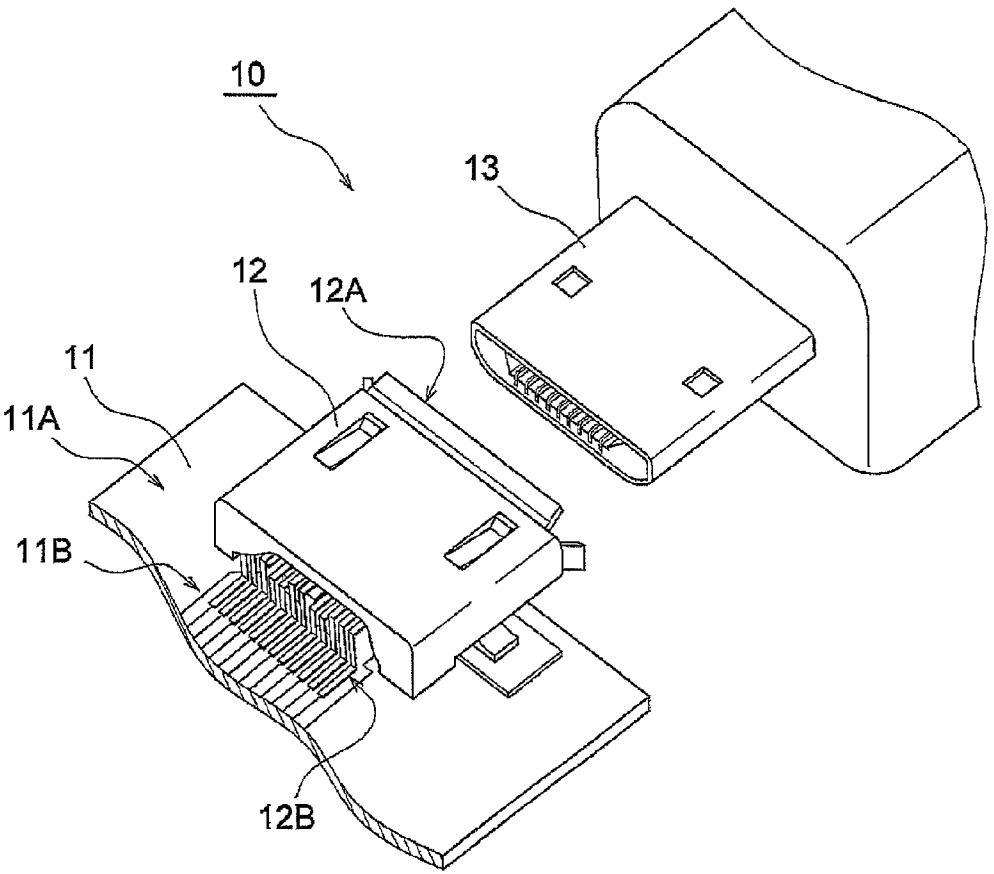
FIG. 1 is a perspective view illustrating the configuration of an interface 10 according to an embodiment.

Next, embodiments of the present invention will be described using the drawings. In the following descriptions of the drawings, identical or similar elements will be given identical or similar reference numerals. However, the drawings are schematic in nature and thus there are cases where the illustrated ratios of dimensions and so on differ from the actual ratios. As such, the specific dimensions should be judged in consideration of the following descriptions. Furthermore, it goes without saying that the drawings include elements whose dimensional relationships, ratios, and so on differ from drawing to drawing.

First Embodiment (Configuration of Interface Between Electronic Devices)

The configuration of an interface between electronic devices according to the present embodiment will be described with reference to the drawings. Specifically, the present embodiment will describe an interface based on the HDMI (High-Definition Multimedia Interface)® standard as an example of an interface between electronic devices.

FIG. 1 is a perspective view illustrating the configuration of an interface 10 according to the present embodiment. As shown in FIG. 1, the interface 10 is configured of a printed wiring board 11, a receptacle 12, and a plug 13.

The printed wiring board 11 is installed within an electronic device (not shown) such as a personal computer. The printed wiring board 11 has a mounting surface 11A and a wire group 11B. The receptacle 12 and various components (not shown) are mounted upon the mounting surface 11A. The wire group 11B transmits signals between the receptacle 12 and the various components.

The receptacle 12 is mounted upon the mounting surface 11A. The receptacle 12 has an opening portion 12A and a terminal group 12B.

The opening portion 12A is provided in the casing of the receptacle 12. The opening portion 12A is a slit into which the plug 13 is inserted. When inserted into the opening portion 12A, the plug 13 fits with a terminal insulation plate 12C, which will be described later. As a result, the receptacle 12 and the plug 13 are connected to each other both electrically and mechanically.

The terminal group 12B is connected to the wire group 11B on the mounting surface 11A. The terminal group 12B transmits signals between the wire group 11B and the plug 13.

(Receptacle Configuration)

Figure 2:
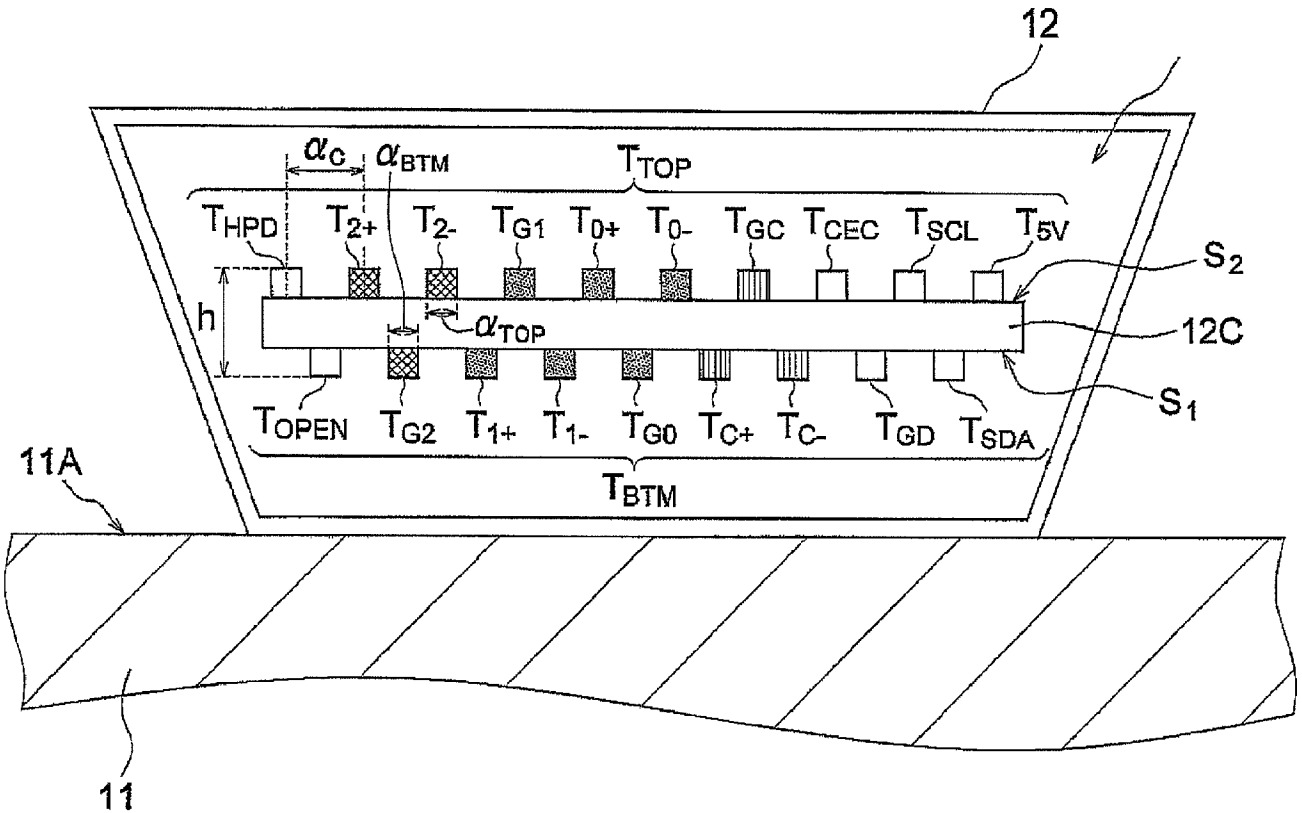
FIG. 2 is a diagram illustrating a receptacle 12 according to an embodiment as viewed from an opening portion 12A side.
Figure 3:
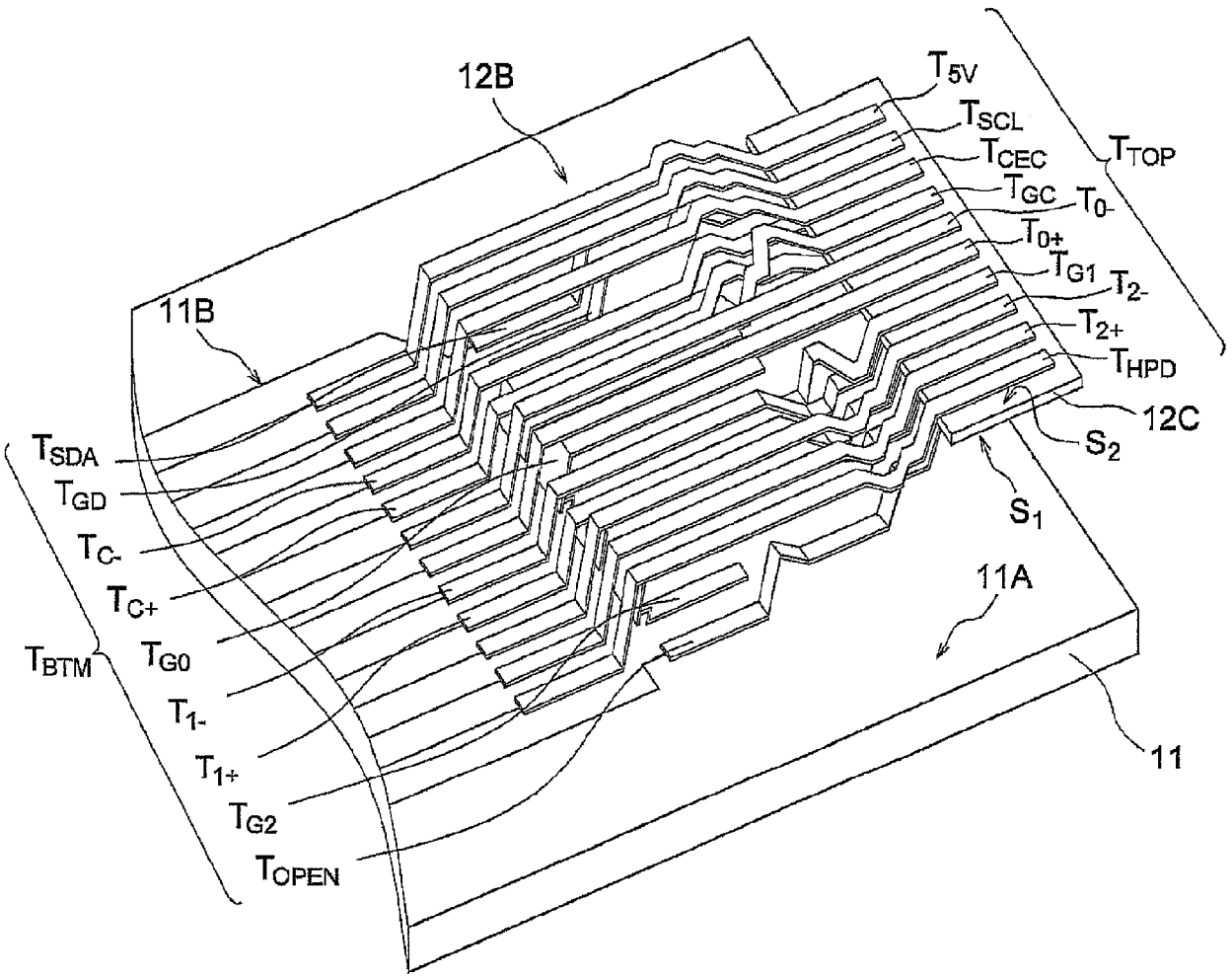
FIG. 3 is a perspective view schematically illustrating a terminal group 12B according to an embodiment.

Next, the configuration of the receptacle according to the present embodiment will be described with reference to the drawings. FIG. 2 is a diagram illustrating the receptacle 12 according to the present embodiment as viewed from the opening portion 12A side. FIG. 3 is a perspective view schematically illustrating the configuration of the terminal group 12B.

As shown in FIGS. 2 and 3, the receptacle 12 has the terminal insulation plate 12C, multiple bottom terminals $T_{BTM}$, and multiple top terminals $T_{TOP}$. Note that the multiple bottom terminals $T_{BTM}$ and the multiple top terminals $T_{TOP}$ configure the terminal group 12B according to the present embodiment.

The terminal insulation plate 12C is formed in a plate shape, and is disposed above the mounting surface 11A. The terminal insulation plate 12C is fitted into the plug 13. The terminal insulation plate 12C has a first primary surface $S_1$ and a second primary surface $S_2$. The first primary surface $S_1$ is provided distanced from the mounting surface 11A. The second primary surface $S_2$ is provided on the side opposite to the mounting surface 11A relative to the first primary surface $S_1$. In the present embodiment, the first primary surface $S_1$ and the second primary surface $S_2$ are each provided so as to be approximately parallel to the mounting surface 11A, but the embodiment is not limited thereto.

The multiple bottom terminals $T_{BTM}$ are configured of an open terminal $T_{OPEN}$, a ground terminal $T_{G2}$, a pair of signal terminals $T_{1+}$ and $T_{1-}$, a ground terminal $T_{G0}$, a pair of signal terminals $T_{C+}$ and $T_{C-}$, a ground terminal $T_{GD}$, and an SDA terminal $T_{SDA}$. The multiple bottom terminals $T_{BTM}$ are each connected to the first primary surface $S_1$ and the mounting surface 11A, as shown in FIG. 3. In other words, one end of each bottom terminal $T_{BTM}$ is disposed upon the first primary surface $S_1$, and the other end of each bottom terminal $T_{BTM}$ is disposed upon the mounting surface 11A.

The multiple top terminals $T_{TOP}$ are configured of an HPD signal terminal $T_{HPD}$, a pair of signal terminals $T_{2+}$ and $T_{2-}$, a ground terminal $T_{G1}$, a pair of signal terminals $T_{0+}$ and $T_{0-}$, a ground terminal $T_{GC}$, a CEC terminal $T_{CEC}$, an SCL terminal $T_{SCL}$, and a power source terminal $T_{5V}$. The multiple bottom terminals $T_{TOP}$ are each connected to the second primary surface $S_2$ and the mounting surface 11A, as shown in FIG. 3. In other words, one end of each top terminal $T_{TOP}$ is disposed upon the second primary surface $S_2$, and the other end of each top terminal $T_{TOP}$ is disposed upon the mounting surface 11A.

Here, a total thickness h of the bottom terminals $T_{BTM}$, the top terminals $T_{TOP}$, and the insulating plate 12C, a number of terminals $n_{BTM}$ in the multiple bottom terminals $T_{BTM}$, a number of terminals $n_{TOP}$ in the multiple top terminals $T_{TOP}$, a width $\alpha_{BTM}$ of each bottom terminal $T_{BTM}$, a width $\alpha_{TOP}$ of each top terminal $T_{TOP}$, an interval $\alpha_C$ between two bottom terminals $T_{BTM}$ or two top terminals $T_{TOP}$, and so on may be set as appropriate for the standard of the interface 10.

The interface 10 according to the present embodiment is based on the HDMI standard, and in the smallest type thereof, or a type D, the thickness h is approximately 0.6 mm, the number of terminals $n_{BTM}$ is 9, the number of terminals $n_{TOP}$ is 10, the width $\alpha_{BTM}$ and the width $\alpha_{TOP}$ are 0.20 mm, and the terminal interval $\alpha_C$ is 0.4 mm.

Accordingly, the multiple bottom terminals $T_{BTM}$ and the multiple top terminals $T_{TOP}$ are disposed in a zigzag structure, in what is known as a two-level zigzag structure, as shown in FIG. 2.

Meanwhile, the pair of signal terminals $T_{C+}$ and $T_{C-}$, which are adjacent to each other, transmit signals according to a quasi-differential transmission system based on TMDS (Transition Minimized Differential Signaling)® and so on. To be more specific, the phase of the signal transmitted by the signal terminal $T_{C+}$ is inverse relative to the phase of the signal transmitted by the signal terminal $T_{C-}$. Likewise, the pair of signal terminals $T_{0+}$ and $T_{0-}$, the pair of signal terminals $T_{1+}$ and $T_{1-}$, and the pair of signal terminals $T_{2+}$ and $T_{2-}$ each transmit inverse-phase signals according to the quasi-differential transmission system.

The ground terminal $T_{GC}$ is a grounding terminal provided in correspondence with the pair of signal terminals $T_{C+}$ and $T_{C-}$. Likewise, the ground terminal $T_{G1}$ is a grounding terminal provided in correspondence with the pair of signal terminals $T_{1+}$ and $T_{1-}$. Furthermore, the ground terminal $T_{G0}$ corresponds to the pair of signal terminals $T_{0+}$ and $T_{0-}$, and the ground terminal $T_{G2}$ corresponds to the pair of signal terminals $T_{2+}$ and $T_{2-}$.

Here, as shown in FIG. 2, the ground terminal $T_{GC}$ is provided opposite to the pair of signal terminals $T_{C+}$ and $T_{C-}$ with the terminal insulation plate 12C located therebetween. To be more specific, the ground terminal $T_{GC}$ is provided between the signal terminal $T_{C+}$ and the signal terminal $T_{C-}$, with the terminal insulation plate 12C located between the ground terminal $T_{GC}$ and the pair of signal terminals $T_{C+}$ and $T_{C-}$. Likewise, the ground terminal $T_{G1}$ is provided opposite to the pair of signal terminals $T_{1+}$ and $T_{1-}$ with the terminal insulation plate 12C located therebetween.

(Configuration of Wire Group Formed in Printed Wiring Board)

Figure 4:
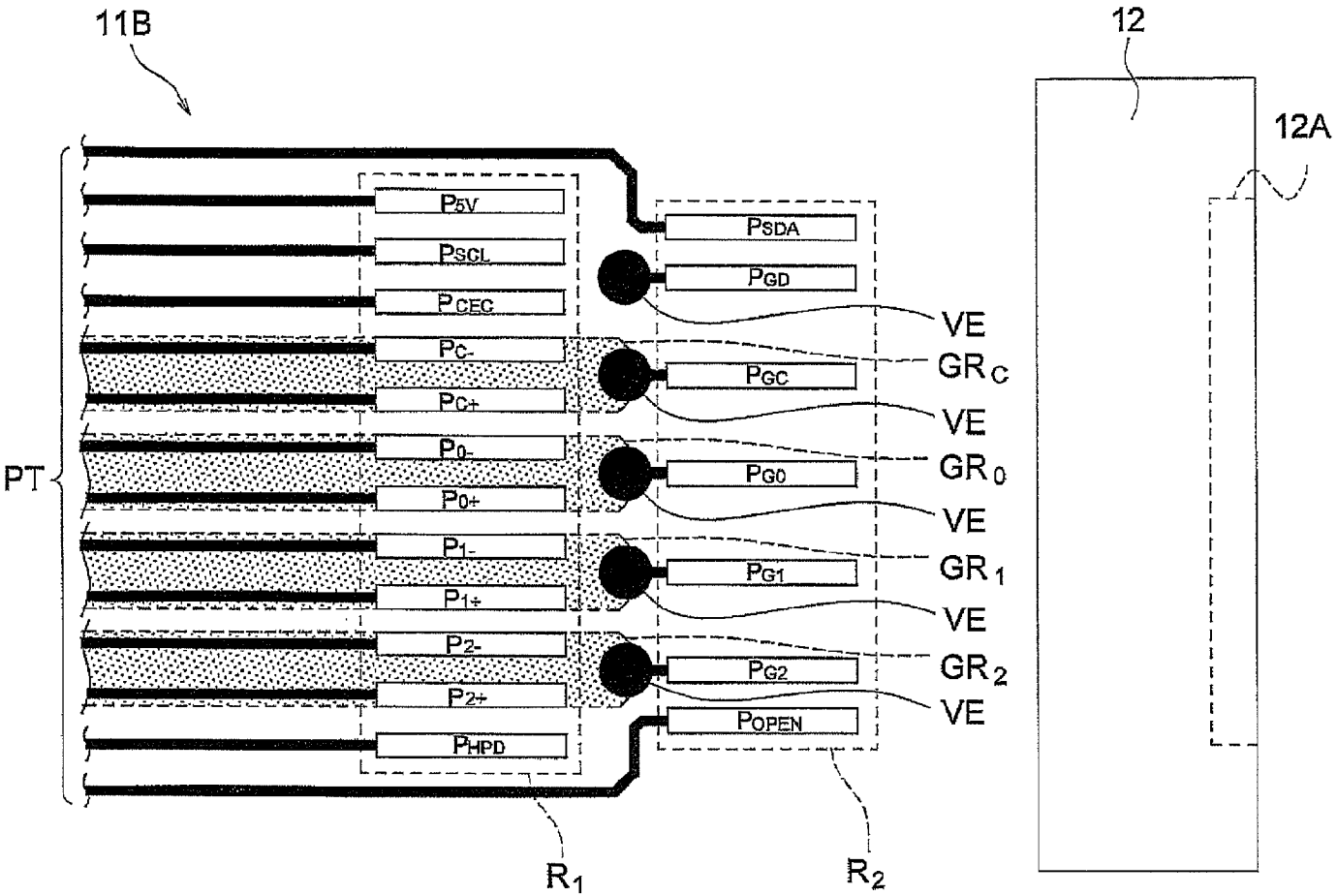
FIG. 4 is a diagram illustrating a wire group 11B and a receptacle 12 according to an embodiment as viewed from a mounting surface 11A side.

Next, the configuration of a wire group according to the present embodiment will be described with reference to the drawings. FIG. 4 is a diagram illustrating the wire group 11B and the receptacle 12 as viewed from the mounting surface 11A side. However, note that in FIG. 4, the terminal group 12B of the receptacle 12 is not shown.

As shown in FIG. 4, the wire group 11B includes a multiple-wire wiring pattern PT, a first connection region $R_1$, a second connection region $R_2$, and four ground regions GR. The multiple-wire wiring pattern PT, the first connection region $R_1$, and the second connection region $R_2$ are provided upon the mounting surface 11A (not shown in FIG. 4; see FIGS. 1 through 3). The four ground regions GR, meanwhile, are provided within the printed wiring board 11.

The multiple-wire wiring pattern PT is connected to each of the first connection region $R_1$ and the second connection region $R_2$, and to the various components (not shown) mounted upon the mounting surface 11A.

When viewed from the mounting surface 11A side, the first connection region $R_1$ is provided at a distance from the opening portion 12A of the receptacle 12. The first connection region $R_1$ is configured of a pair of connection pads $P_{2+}$ and $P_{2-}$, a pair of connection pads $P_{1+}$ and $P_{1-}$ a pair of connection pads $P_{0+}$ and $P_{0-}$, a pair of connection pads $P_{C+}$ and $P_{C-}$, and connection pads $P_{HPD}$, $P_{CEC}$, $P_{SCL}$, and $P_{5V}$.

The pair of connection pads $P_{2+}$ and $P_{2-}$ is connected to the pair of signal terminals $T_{2+}$ and $T_{2-}$. Specifically, the connection pad $P_{2+}$ is connected to the signal terminal $T_{2+}$, and the connection pad $P_{2-}$ is connected to the signal terminal $T_{2-}$. Likewise, the pair of connection pads $P_{1+}$ and $P_{1-}$ is connected to the pair of signal terminals $T_{1+}$ and $T_{1-}$, and the pair of connection pads $P_{C+}$ and $P_{C-}$ is connected to the pair of signal terminals $T_{C+}$ and $T_{C-}$. Furthermore, the connection pads $P_{HPD}$, $P_{CEC}$, $P_{SCL}$, and $P_{5V}$ are respectively connected to the HPD signal terminal $T_{HPD}$, the CEC terminal $T_{CEC}$, the SCL terminal $T_{SCL}$, and the power source terminal $T_{5V}$.

When viewed from the mounting surface 11A side, the second connection region $R_2$ is provided between the opening portion 12A of the receptacle 12 and the first connection region $R_1$. The second connection region $R_2$ is configured of connection pads $P_{GC}$, $P_{G0}$, $P_{G1}$, and $P_{G2}$, a connection pad $P_{OPEN}$, and a connection pad $P_{SDA}$.

The connection pads $P_{GC}$, $P_{G0}$, $P_{G1}$, and $P_{G2}$ are connected to the ground terminals $T_{GC}$, $T_{G0}$, $T_{G1}$, and $T_{G2}$, respectively. Meanwhile, the connection pads $P_{OPEN}$ and $P_{SDA}$ are connected to the open terminal $T_{OPEN}$, the CEC terminal $T_{CEC}$, and the SDA terminal $T_{SDA}$, respectively.

In this manner, in the present embodiment, four pairs of signal terminals included in the terminal group 12B are collected in the first connection region $R_1$. Meanwhile, five ground terminals included in the terminal group 12B are collected in the second connection region $R_2$.

Finally, the first connection region $R_1$ and the second connection region $R_2$ are structured so that, when viewed from the mounting surface 11A side, the pads P of the second connection region $R_2$ are disposed between the pads P of the first connection region $R_1$.

The four ground regions GR include a ground region $GR_C$, a ground region $GR_0$, a ground region $GR_1$, and a ground region $GR_2$. The ground region $GR_C$ is electrically connected to the connection pad $P_{GC}$ via a via hole electrode VE. The ground region $GR_C$ is extended toward the side opposite to the opening portion 12, starting at the via hole electrode VE. Meanwhile, the ground region $GR_0$, the ground region $GR_1$, and the ground region $GR_2$ are configured in the same manner as the ground region $GR_C$.

Note that the via hole electrodes VE are formed by filling via holes (not shown) extended from the mounting surface 11A toward the interior of the printed wiring board 11 with conductors.

Here, as shown in FIG. 4, the pair of connection pads $P_{C+}$ and $P_{C-}$ are formed in a region of the mounting surface 11A that corresponds to the ground region $GR_C$. Therefore, the pair of connection pads $P_{C+}$ and $P_{C-}$ to which the pair of signal terminals $T_{C+}$ and $T_{C-}$ are connected are distanced from the opening portion 12A more than the connection pad $P_{GC}$ to which the ground terminal T is connected. In addition, the pair of connection pads $P_{0+}$ and $P_{0-}$, the pair of connection pads $P_{1+}$ and $P_{1-}$, and the pair of connection pads $P_{2+}$ and $P_{2-}$ are respectively configured in the same manner as the pair of connection pads $P_{C+}$ and $P_{C-}$.

(Detailed Configuration of Terminals)

Next, a detailed configuration of the terminals will be described with reference to the drawings.

Figure 5:
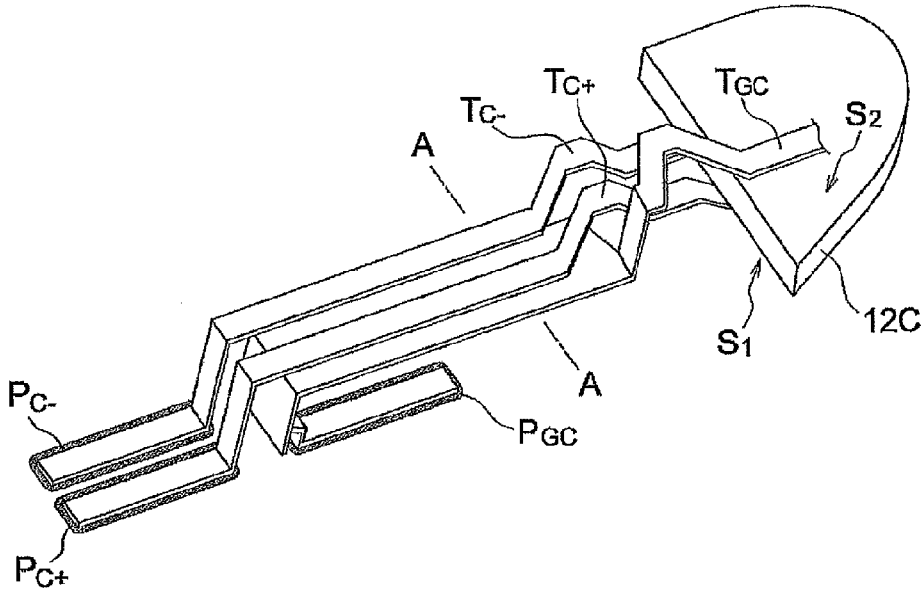
FIG. 5 is a perspective view illustrating a ground terminal $T_{GC}$ and a pair of signal terminals $T_{C+}$ and $T_{C-}$ according to an embodiment.
Figure 6:
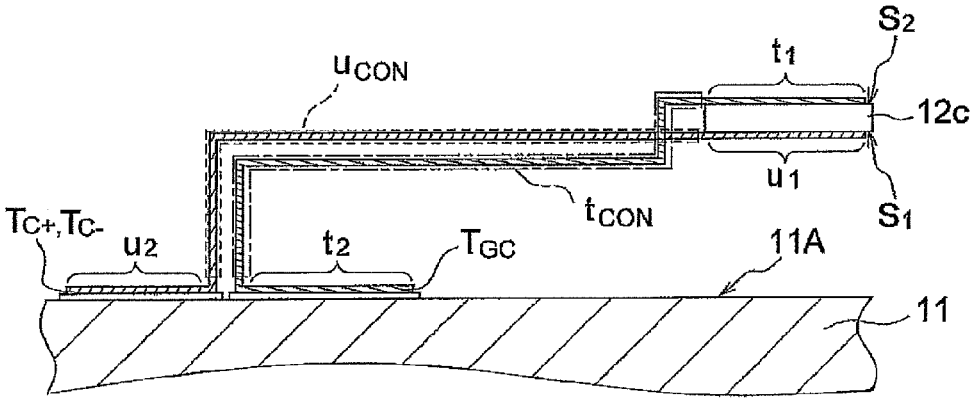
FIG. 6 is a side view of a ground terminal $T_{GC}$ and a pair of signal terminals $T_{C+}$ and $T_{C-}$ according to an embodiment.
Figure 7:
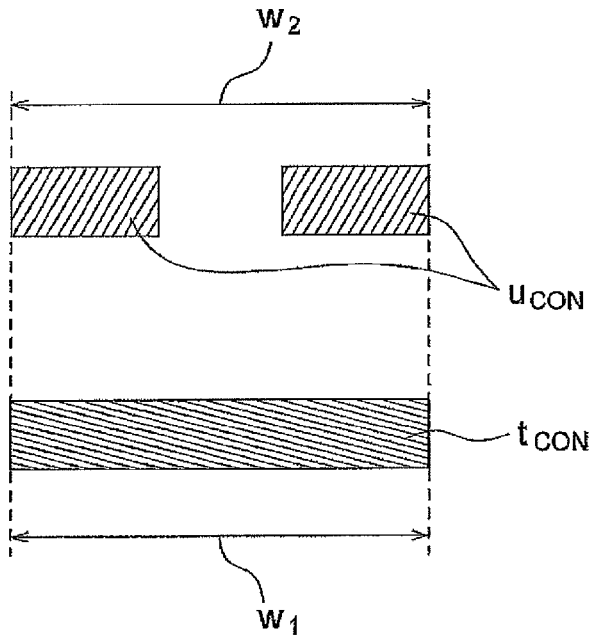
FIG. 7 is a cross-section viewed along the A-A line shown in FIG. 5.

1. Configuration of Ground Terminal $T_{GC}$ and Pair of Signal Terminals $T_{C+}$ and $T_{C-}$ FIG. 5 is a perspective view illustrating the ground terminal $T_{GC}$ and the pair of signal terminals $T_{C+}$ and $T_{C-}$. FIG. 6 is a side view illustrating the ground terminal $T_{GC}$ and the pair of signal terminals $T_{C+}$ and $T_{C-}$. FIG. 7 is a cross-section viewed along the A-A line shown in FIG. 5.

As shown in FIG. 5, the pair of signal terminals $T_{C+}$ and $T_{C-}$ is connected to the first primary surface $S_1$ of the terminal insulation plate 12C and the mounting surface 11A. To be more specific, as shown in FIG. 6, each terminal in the pair of signal terminals $T_{C+}$ and $T_{C-}$ has a first signal terminal end portion $u_1$, a second signal terminal end portion $u_2$, and a signal terminal link portion $u_{CON}$. The first signal terminal end portion $u_1$ is connected to the first primary surface $S_1$ of the terminal insulation plate 12C. The second signal terminal end portion $u_2$ is connected to the pair of connection pads $P_{C+}$ and $P_{C-}$ on the mounting surface 11A of the printed wiring board 11. The signal terminal link portion $u_{CON}$ links the first signal terminal end portion $u_1$ and the second signal terminal end portion $u_2$.

Meanwhile, as shown in FIG. 5, the ground terminal $T_{GC}$ is connected to the second primary surface $S_2$ of the terminal insulation plate 12C and the mounting surface 11A. To be more specific, as shown in FIG. 6, the ground terminal $T_{GC}$ has a first ground terminal end portion $t_1$, a second ground terminal end portion $t_2$, and a ground terminal link portion $t_{CON}$. The first ground terminal end portion $t_1$ is connected to the second primary surface $S_2$ of the terminal insulation plate 12C. The second ground terminal end portion $t_2$ is connected to the connection pad $P_{GC}$ on the mounting surface 11A of the printed wiring board 11. The ground terminal link portion $t_{CON}$ links the first ground terminal end portion $t_1$ and the second ground terminal end portion $t_2$.

Here, as shown in FIGS. 5 and 6, the ground terminal link portion $t_{CON}$ is wired between the signal terminal link portion $u_{CON}$ and the mounting surface 11A from an opposite side of the mounting surface 11A relative to the signal terminal link portion $u_{CON}$, passing a side of the pair of signal terminals $T_{C+}$ and $T_{C-}$link portion. The vertical positions of the ground terminal $T_{GC}$ and the position of the pair of signal terminals $T_{C+}$ and $T_{C-}$ are thus inverted. As a result, the ground terminal $T_{GC}$ is connected to the mounting surface 11A short of the pair of signal terminals $T_{C+}$ and $T_{C-}$. Accordingly, the second ground terminal end portion $t_2$ is provided between the second signal terminal end portion $u_2$ and the opening portion 12A (not shown in FIGS. 5 and 6; see FIGS. 2 and 4).

Meanwhile, the ground terminal link portion $t_{CON}$ is provided along the signal terminal link portion $u_{CON}$. In the present embodiment, the portion (called a "bottom portion" hereinafter) of the ground terminal link portion $t_{CON}$ that is disposed between the signal terminal link portion $u_{CON}$ and the mounting surface 11A is longer than the portion (called a "top portion" hereinafter) of the ground terminal link portion $t_{CON}$ that is disposed on the opposite side of the mounting surface 11A relative to the signal terminal link portion $u_{CON}$, but the configuration is not limited thereto. The bottom portion may be shorter than the top portion. Alternatively, the bottom portion may be of the same length as the top portion.

Meanwhile, the ground terminal $T_{GC}$ is formed at a greater width in the ground terminal link portion $t_{CON}$. As a result, when viewed from the mounting surface 11A side, the width of the ground terminal link portion $t_{CON}$ is greater than the width of the first ground terminal end portion $t_1$.

To be more specific, as shown in FIG. 7, a width $w_1$ of the ground terminal link portion $t_{CON}$ is the same as a width $w_2$ of the pair of signal terminal link portions $u_{CON}$. In this manner, the sides of the signal terminal link portions $u_{CON}$ of each of the signal terminals $T_{C+}$ and $T_{C-}$ that face the mounting surface 11A are covered by the ground terminal link portion $t_{CON}$. Accordingly, a coupled microstrip line whose ground surface is the ground terminal link portion $t_{CON}$ is formed by the pair of signal terminals $T_{C+}$ and $T_{C-}$ and the ground terminal $T_{GC}$. Note that it is preferable for the width $w_1$ of the ground terminal link portion $t_{CON}$ to be greater than the width $w_2$ of the pair of signal terminal link portions $u_{CON}$.

Meanwhile, on the mounting surface 11A, the second ground terminal end portion $t_2$ is bent back toward the opening portion 12A side (see FIGS. 2 and 4).

Figure 8:
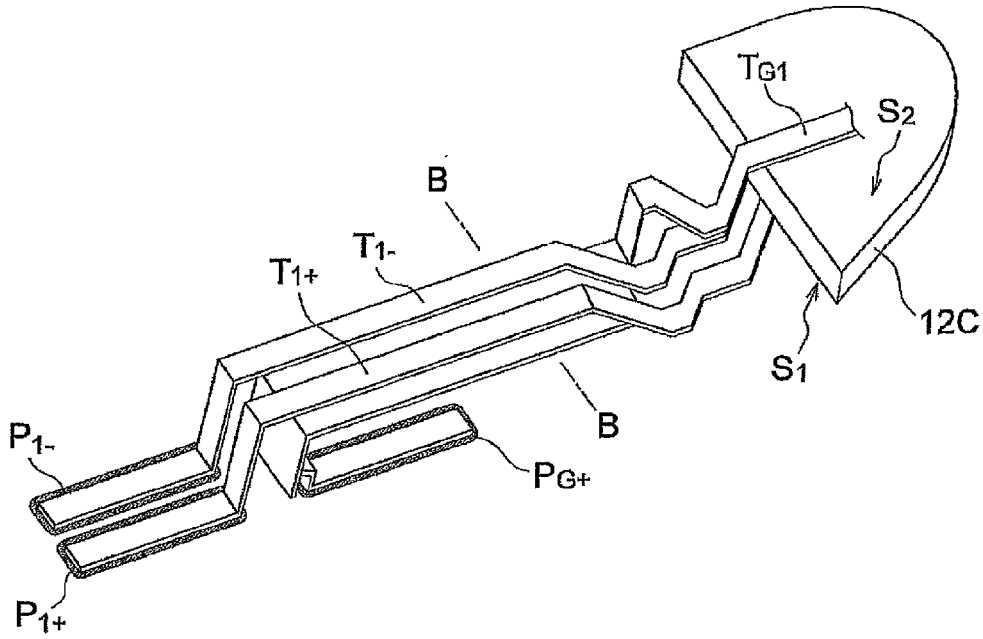
FIG. 8 is a perspective view illustrating a ground terminal $T_{G1}$ and a pair of signal terminals $T_{1+}$ and $T_{1-}$ according to an embodiment.
Figure 9:
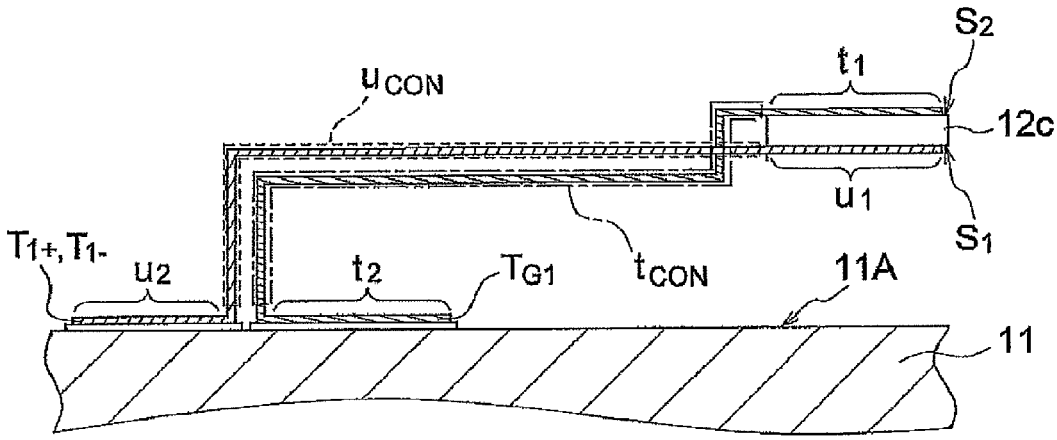
FIG. 9 is a side view illustrating a ground terminal $T_{G1}$ and a pair of signal terminals $T_{1+}$ and $T_{1-}$ according to an embodiment.
Figure 10:
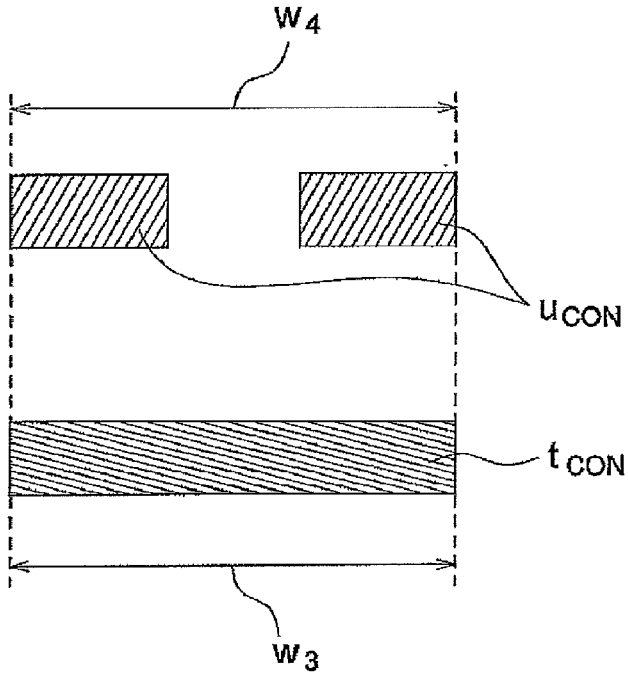
FIG. 10 is a cross-section viewed along the B-B line shown in FIG. 8.

2. Configuration of Ground Terminal $T_{G1}$ and Pair of Signal Terminals $T_{1+}$ and $T_{1-}$ FIG. 8 is a perspective view illustrating the ground terminal $T_{G1}$ and the pair of signal terminals $T_{1+}$ and $T_{1-}$. FIG. 9 is a side view illustrating the ground terminal $T_{G1}$ and the pair of signal terminals $T_{1+}$ and $T_{1-}$. FIG. 10 is a cross-section viewed along the B-B line shown in FIG. 8.

As shown in FIG. 8, each of the pair of signal terminals $T_{1+}$ and $T_{1-}$ has a first signal terminal end portion $u_1$, a second signal terminal end portion $u_2$, and a signal terminal link portion $u_{CON}$. The ground terminal $T_{G1}$ has a first ground terminal end portion $t_1$, a second ground terminal end portion $t_2$, and a ground terminal link portion $t_{CON}$.

Here, as shown in FIGS. 8 and 9, the ground terminal link portion $t_{CON}$ is wired between the signal terminal link portion $u_{CON}$ and the mounting surface 11A from an opposite side of the mounting surface 11A relative to the signal terminal link portion $u_{CON}$, passing a side of the pair of signal terminals $T_{1+}$ and $T_{1-}$link portion.

Furthermore, as shown in FIG. 10, a width $w_3$ of the ground terminal link portion $t_{CON}$ is the same as a width $w_4$ of the pair of signal terminal link portions $u_{CON}$. In this manner, the sides of the pair of signal terminal link portions $u_{CON}$ that face the mounting surface 11A are covered by the ground terminal link portion $t_{CON}$. Accordingly, a coupled microstrip line whose ground surface is the ground terminal link portion $t_{CON}$ is formed by the pair of signal terminals $T_{1+}$ and $T_{1-}$ and the ground terminal $T_{G1}$. Note that it is preferable for the width $w_3$ of the ground terminal link portion taw to be greater than the width $w_4$ of the pair of signal terminal link portions $u_{CON}$.

Meanwhile, on the mounting surface 11A, the second ground terminal end portion $t_2$ is bend back toward the opening portion 12A side (not shown in FIGS. 8 and 9; see FIGS. 2 and 4).

3. Configuration of Ground Terminal $T_{G0}$ and Pair of Signal Terminals $T_{0+}$ and $T_{0-}$ FIG. 11 is a perspective view illustrating the ground terminal $T_{G0}$ and the pair of signal terminals $T_{0+}$ and $T_{0-}$.

Figure 11:
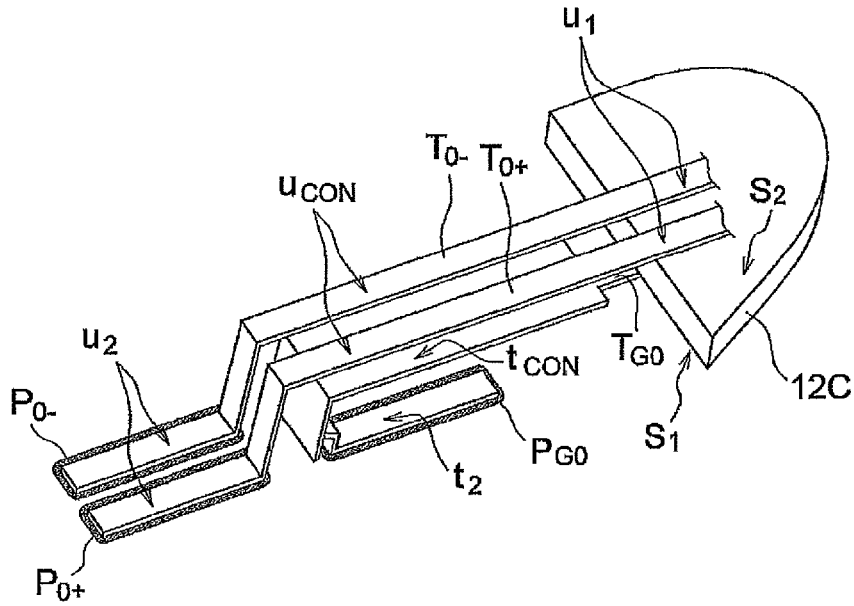
FIG. 11 is a perspective view illustrating a ground terminal $T_{G0}$ and a pair of signal terminals $T_{0+}$ and $T_{0-}$ according to an embodiment.

As shown in FIG. 11, each of the pair of signal terminals $T_{0+}$ and $T_{0-}$ has a first signal terminal end portion $u_1$, a second signal terminal end portion $u_2$, and a signal terminal link portion $u_{CON}$. The ground terminal $T_{G0}$ has a first ground terminal end portion $t_1$ (not shown in FIG. 11), a second ground terminal end portion $t_2$, and a ground terminal link portion $t_{CON}$. In this regard, the first signal terminal end portion $u_1$ is connected to the second primary surface $S_2$ of the terminal insulation plate 12C, and the first ground terminal end portion $t_1$ is connected to the first primary surface $S_1$ of the terminal insulation plate 12C. For this reason, the ground terminal $T_{G0}$ is disposed between the pair of signal terminals $T_{0+}$ and $T_{0-}$ and the mounting surface 11A.

Here, the ground terminal link portion $t_{CON}$ is provided along the signal terminal link portion $u_{CON}$. Furthermore, the width of the ground terminal link portion $t_{CON}$ is greater than the width of the first ground terminal end portion $t_1$, and the side of the signal terminal link portion $u_{CON}$ that faces the mounting surface 11A is covered by the ground terminal link portion $t_{CON}$. Accordingly, a coupled microstrip line whose ground surface is the ground terminal link portion $t_{CON}$ is formed by the pair of signal terminals $T_{0+}$ and $T_{0-}$ and the ground terminal $T_{G0}$.

Meanwhile, on the mounting surface 11A, the second ground terminal end portion $t_2$ is bent back toward the opening portion 12A side (not shown in FIG. 11; see FIGS. 2 and 4).

4. Configuration of Ground Terminal $T_{G2}$ and Pair of Signal Terminals $T_{2+}$ and $T_{2-}$ FIG. 12 is a perspective view illustrating the ground terminal $T_{G2}$ and the pair of signal terminals $T_{2+}$ and $T_{2-}$.

Figure 12:
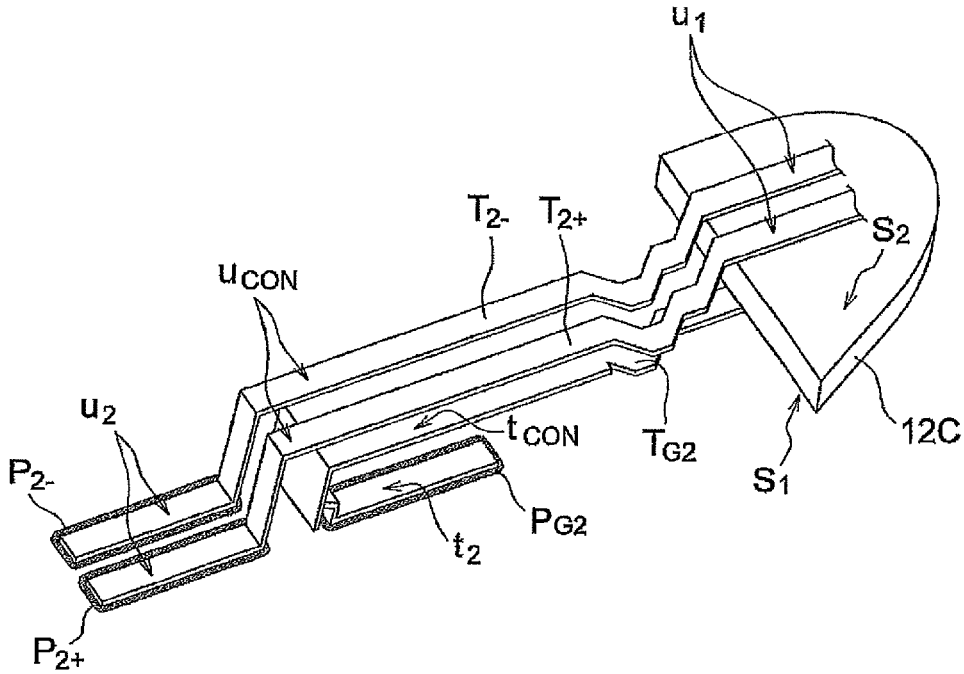
FIG. 12 is a perspective view illustrating a ground terminal $T_{G2}$ and a pair of signal terminals $T_{2+}$ and $T_{2-}$ according to an embodiment.

As shown in FIG. 12, each of the signal terminals $T_{2+}$ and $T_{2-}$ has a first signal terminal end portion $u_1$, a second signal terminal end portion $u_2$, and a signal terminal link portion $u_{CON}$. The ground terminal $T_{G2}$ has a first ground terminal end portion $t_1$ (not shown in FIG. 12), a second ground terminal end portion $t_2$, and a ground terminal link portion $t_{CON}$. In this regard, the first signal terminal end portion $u_1$ is connected to the second primary surface $S_2$ of the terminal insulation plate 12C, and the first ground terminal end portion $t_1$ is connected to the first primary surface $S_1$ of the terminal insulation plate 12C. For this reason, the ground terminal $T_{G2}$ is disposed between the pair of signal terminals $T_{2+}$ and $T_{2-}$ and the mounting surface 11A.

Here, the ground terminal link portion $t_{CON}$ is provided along the signal terminal link portion $u_{CON}$. Furthermore, the width of the ground terminal link portion $t_{CON}$ is formed so as to be greater than the width of the first ground terminal end portion $t_1$, and the side of the signal terminal link portion $u_{CON}$ that faces the mounting surface 11A is covered by the ground terminal link portion $t_{CON}$. Accordingly, a coupled microstrip line whose ground surface is the ground terminal link portion $t_{CON}$ is formed by the pair of signal terminals $T_{2+}$ and $T_{2-}$ and the ground terminal $T_{G2}$.

Meanwhile, on the mounting surface 11A, the second ground terminal end portion $t_2$ is bend back toward the opening portion 12A (not shown in FIG. 12; see FIGS. 2 and 4).

(Operations and Effects)

The receptacle 12 according to the first embodiment includes the terminal insulation plate 12C, a pair of signal terminals $T_{C+}$ and $T_{C-}$ adjacent to each other, and a ground terminal $T_{GC}$ corresponding to the pair of signal terminals $T_{C+}$ and $T_{C-}$. The pair of signal terminals $T_{C+}$ and $T_{C-}$ has the signal terminal link portion $u_{CON}$ that links the first signal terminal end portion $u_1$ and the second signal terminal end portion $u_2$. The ground terminal $T_{GC}$ has the ground terminal link portion $t_{CON}$ that links the first ground terminal end portion $t_1$ and the second ground terminal end portion $t_2$. The ground terminal link portion $t_{CON}$ is wired between the signal terminal link portion $u_{CON}$ and the mounting surface 11A from the opposite side of the mounting surface 11A relative to the signal terminal link portion $u_{CON}$.

In this manner, the ground terminal T is wired between the pair of signal terminals $T_{1+}$ and $T_{1-}$ and the mounting surface 11A from the opposite side of the mounting surface 11A relative to the pair of signal terminals $T_{C+}$ and $T_{C-}$. For this reason, the ground terminal $T_{GC}$ can be connected to the mounting surface 11A short of the pair of signal terminals $T_{C+}$ and $T_{C-}$, and the connection pad $P_{GC}$ is thus formed more toward the opening portion 12A than the pair of connection pads $P_{C+}$ and $P_{C-}$. Accordingly, it is no longer necessary to provide wiring between the connection pads P upon the printed wiring board, and is thus unnecessary to apply detailed wiring rules to the wiring upon the mounting surface 11A. Furthermore, because it is unnecessary to provide wiring within the printed wiring board, the wiring pattern PT formed upon the mounting surface 11A can be reduced. As a result, an increase in the manufacturing cost of the printed wiring board 11 can be suppressed, as can a drop in the quality of transmitted signals in the printed wiring board 11.

Furthermore, the size of the region in which the wiring pattern PT is formed can be reduced more than in the case where the connection pad $P_{GC}$ and the pair of connection pads $P_{C+}$ and $P_{C-}$ are provided side-by-side, or in other words, the case where the connection pad $P_{GC}$ is provided between the connection pad $P_{GC}$ and the connection pad $P_{C+}$.

Meanwhile, the ground terminal link portion $t_{CON}$ according to the present embodiment is provided along the signal terminal link portion $u_{CON}$. As a result, the noise resistance of the pair of signal terminals $T_{C+}$ and $T_{C-}$ can be improved.

In addition, the second ground terminal end portion $t_2$ according to the present embodiment is bent back toward the opening portion 12A. As a result, the portion of the ground terminal link portion $t_{CON}$ that is provided along the signal terminal link portion $u_{CON}$ can be lengthened. Accordingly, the noise resistance of the pair of signal terminals $T_{C+}$ and $T_{C-}$ can be further improved.

In addition, the width of the ground terminal link portion $t_{CON}$ according to the present embodiment is greater than the width of the first ground terminal end portion $t_1$. As a result, the noise resistance of the pair of signal terminals $T_{C+}$ and $T_{C-}$ can be improved.

In addition, in the present embodiment, the side of the signal terminal link portion $u_{CON}$ that faces the mounting surface 11A is covered by the ground terminal link portion $t_{CON}$. To be more specific, the width $w_1$ of the ground terminal link portion $t_{CON}$ is greater than or equal to the width $w_2$ of the pair of signal terminal link portions $u_{CON}$. For this reason, a coupled microstrip line whose ground surface is the ground terminal link portion $t_{CON}$ is formed by the pair of signal terminals $T_{C+}$ and $T_{C-}$ and the ground terminal $T_{GC}$. Accordingly, the noise resistance of the pair of signal terminals $T_{C+}$ and $T_{C-}$ can be further improved.

Note that the same effects as those describe above can be achieved within the relationship between the ground terminal $T_{G1}$ and the pair of signal terminals $T_{1+}$ and $T_{1-}$ as well.

Second Embodiment

Next, the configuration of a receptacle 12 according to a second embodiment will be described with reference to the drawings. Hereinafter, the differences from the first embodiment will mainly be described. The difference from the first embodiment is that the link portions of the bottom terminals $T_{BTM}$ are twisted by approximately 90 degrees.

Hereinafter, descriptions will be given using the configurations of the ground terminal $T_{GC}$ and the pair of signal terminals $T_{C+}$ and $T_{C-}$ as examples. It should be noted that these configurations can also be applied to the ground terminal $T_{G1}$ and the pair of signal terminals $T_{1+}$ and $T_{1-}$.

(Configuration of Ground Terminal $T_{GC}$ and Pair of Signal Terminals $T_{C+}$ and $T_{C-}$)

Figure 13:
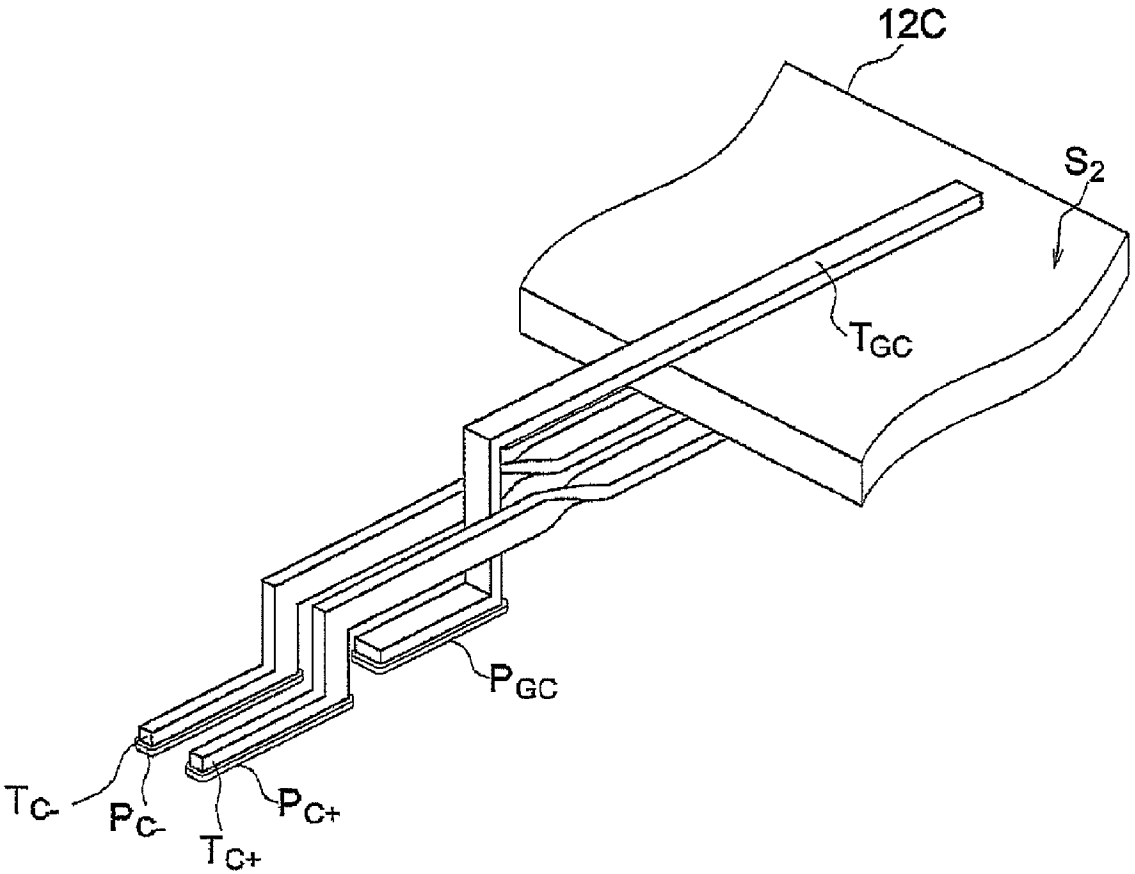
FIG. 13 is a perspective view illustrating a ground terminal $T_{GC}$ and a pair of signal terminals $T_{C+}$ and $T_{C-}$ according to a second embodiment.
Figure 14:
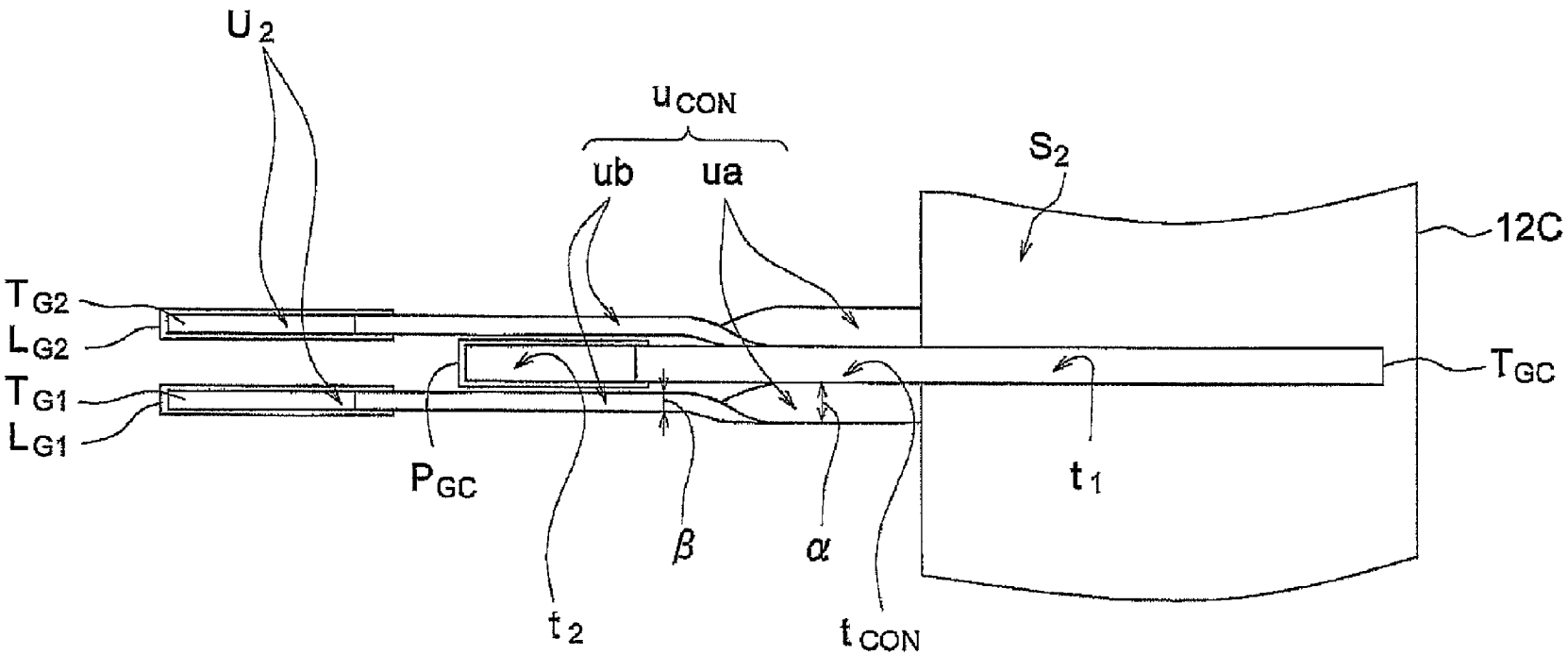
FIG. 14 is a plan view illustrating a ground terminal $T_{GC}$ and a pair of signal terminals $T_{C+}$ and $T_{C-}$ according to a second embodiment, as viewed from an upper surface $S_2$ side.
Figure 15:
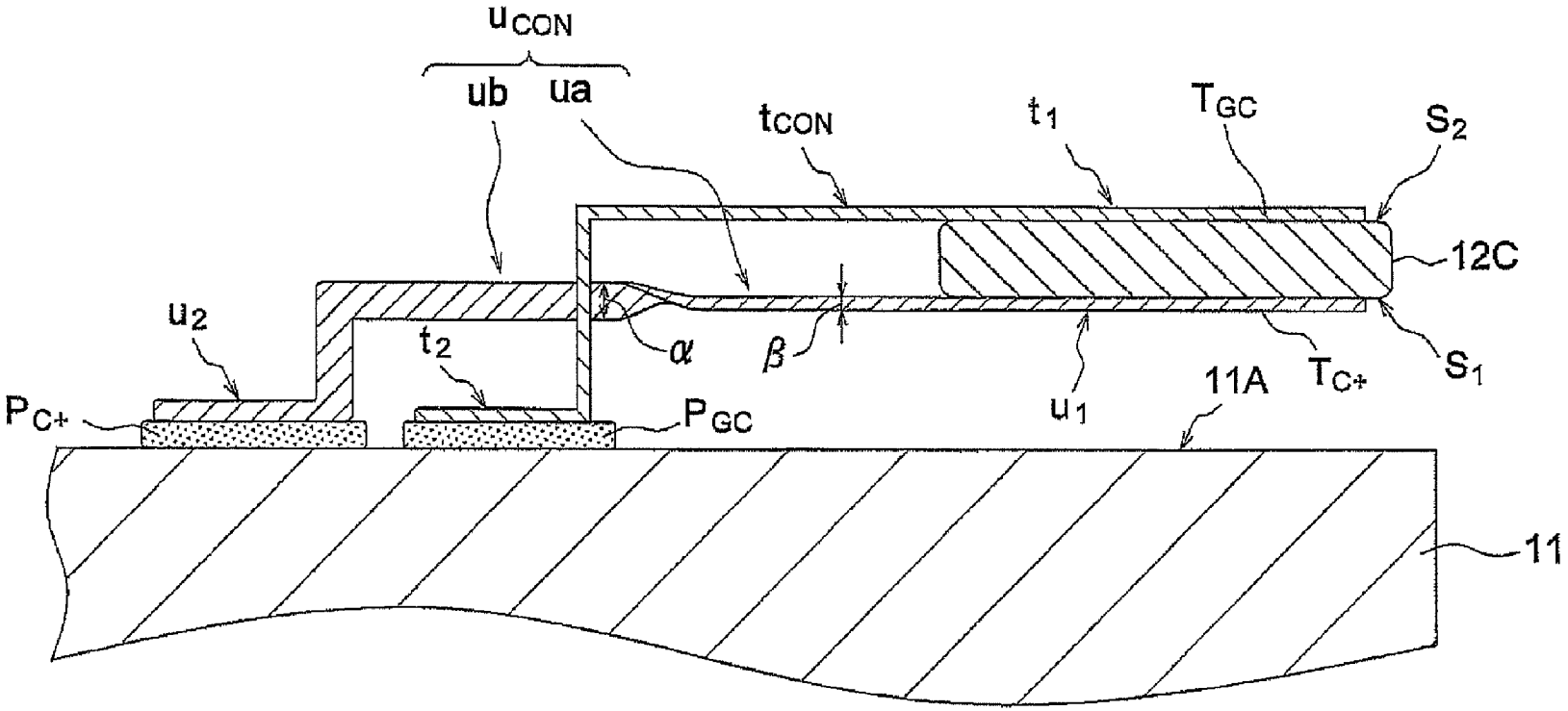
FIG. 15 is a side view illustrating a ground terminal $T_{GC}$ and a pair of signal terminals $T_{C+}$ and $T_{C-}$ according to the second embodiment.

The configuration of the ground terminal $T_{GC}$ and the pair of signal terminals $T_{C+}$ and $T_{C-}$ will be described with reference to the drawings. FIG. 13 is a perspective view illustrating the ground terminal $T_{GC}$ and the pair of signal terminals $T_{C+}$ and $T_{C-}$. FIG. 14 is a plan view illustrating the ground terminal $T_{GC}$ and the pair of signal terminals $T_{C+}$ and $T_{C-}$ as seen from the top surface $S_2$ side. FIG. 15, meanwhile, is a side view illustrating the ground terminal $T_{GC}$ and the pair of signal terminals $T_{C+}$ and $T_{C-}$.

As shown in FIG. 13, the signal terminal link portions $u_{CON}$ of each terminal in the pair of signal terminals $T_{C+}$ and $T_{C-}$ is twisted by approximately 90 degrees. This increases the interval between terminals.

Specifically, as shown in FIGS. 14 and 15, each of the terminals in the pair of signal terminals $T_{C+}$ and $T_{C-}$ has a wide portion $u_a$ and a narrow portion $u_b$.

The wide portion $u_a$ is connected to the first signal terminal end portion $u_1$, and extends from the first signal terminal end portion $u_1$ to the outer side of the first primary surface $S_1$. The narrow portion $u_b$ is connected to the wide portion $u_a$, and extends from the wide portion $u_a$ toward the second signal terminal end portion $u_2$.

Here, the wide portion $u_a$ and the narrow portion $u_b$ are formed by bending plate-shaped metallic pieces by approximately 90 degrees. Accordingly, a width a of the wide portion $u_a$ when viewed from above the second primary surface $S_2$ is equivalent to a thickness $\alpha$ of the narrow portion $u_b$ when viewed from the side. Furthermore, a thickness $\beta$ ($<\alpha$) of the wide portion $u_a$ when viewed from the side is equivalent to a width $\beta$ of the narrow portion $u_b$ when viewed from above. Accordingly, when viewed from the second primary surface $S_2$, the width $\beta$ of the narrow portion $u_b$ is less than the width $\alpha$ of the wide portion $u_a$.

The ground terminal $T_{GC}$ is wired between the pair of narrow portions $u_b$. The vertical positions of the ground terminal $T_{GC}$ and the pair of signal terminals $T_{C+}$ and $T_{C-}$ are thus inverted.

(Operations and Effects)

In the receptacle 12 according to the second embodiment, each of the pair of signal terminals $T_{C+}$ and $T_{C-}$ has the narrow portion $u_b$. The ground terminal $T_{GC}$ is wired between the pair of narrow portions $u_b$.

Accordingly, a space for providing the ground terminal $T_{GC}$ can be secured between the pair of narrow portions $u_b$. This makes it possible to dispose the ground terminal $T_{GC}$ and the pair of signal terminals $T_{C+}$ and $T_{C-}$ in a linear manner. As a result, the terminal structure can be simplified.

Third Embodiment

Next, the configuration of a receptacle 12 according to a third embodiment will be described with reference to the drawings. Hereinafter, the differences from the first embodiment will mainly be described. The difference from the first embodiment is that the vertical positions of the ground terminal $T_{GC}$ and the pair of signal terminals $T_{C+}$ and $T_{C-}$ are inverted within the terminal insulation plate 12C.

Hereinafter, descriptions will be given using the configurations of the ground terminal $T_{GC}$ and the pair of signal terminals $T_{C+}$ and $T_{C-}$ as examples. It should be noted that these configurations can also be applied to the ground terminal $T_{G1}$ and the pair of signal terminals $T_{1+}$ and $T_{1-}$.

(Receptacle Configuration)

Figure 16:
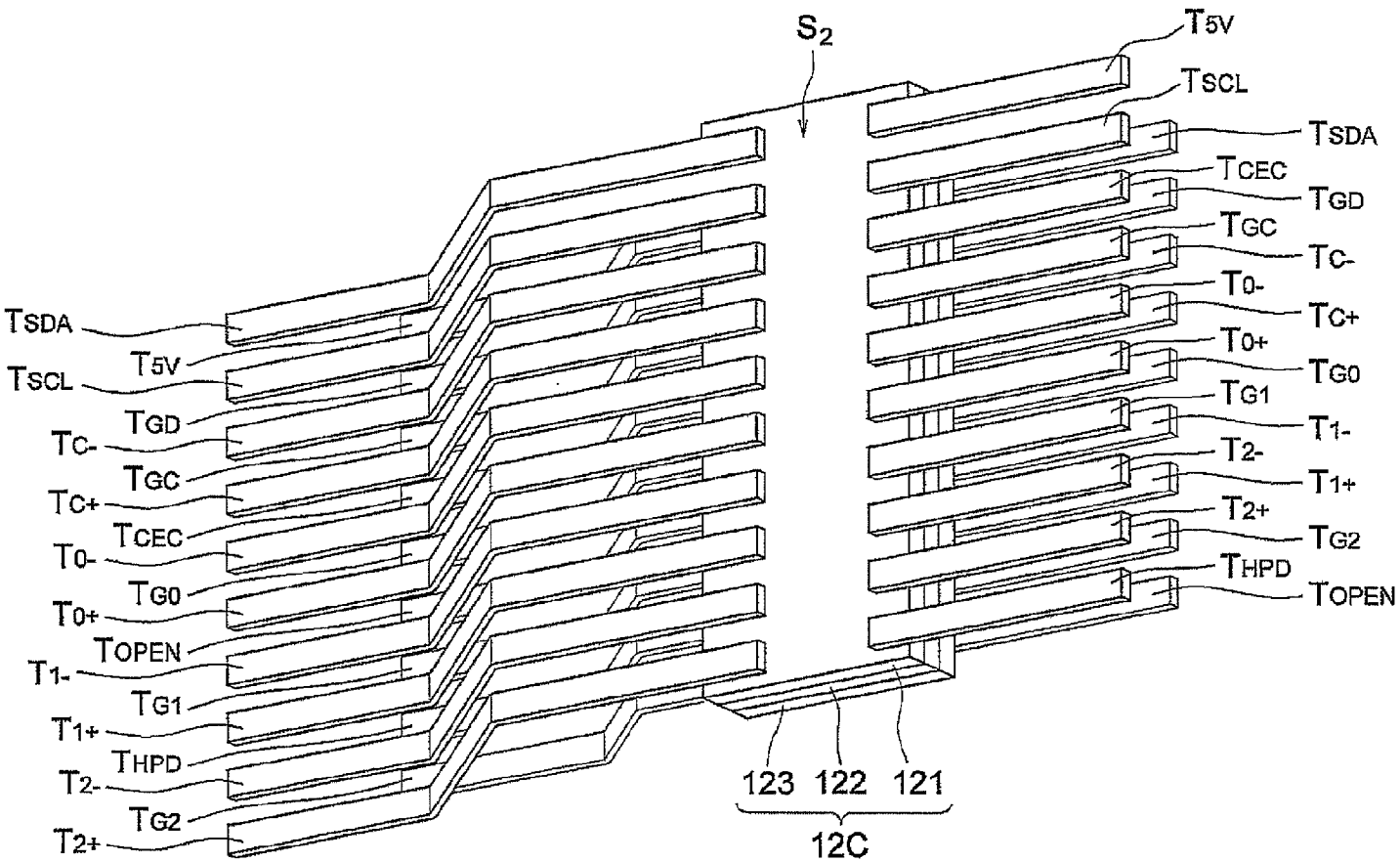
FIG. 16 is a perspective view illustrating a receptacle 12 according to a third embodiment as viewed from a second primary surface $S_2$ side.
Figure 17:
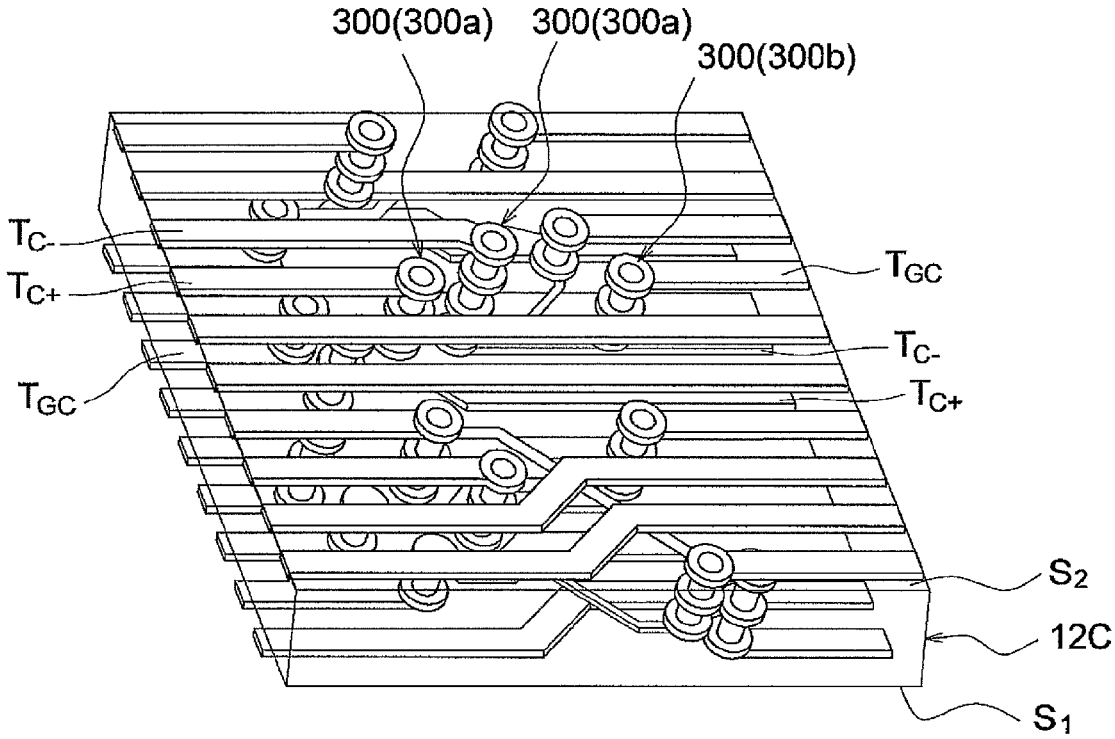
FIG. 17 is a see-through perspective view illustrating a terminal insulation plate 12C according to the third embodiment as viewed from a second primary surface $S_2$ side.
Figure 18:
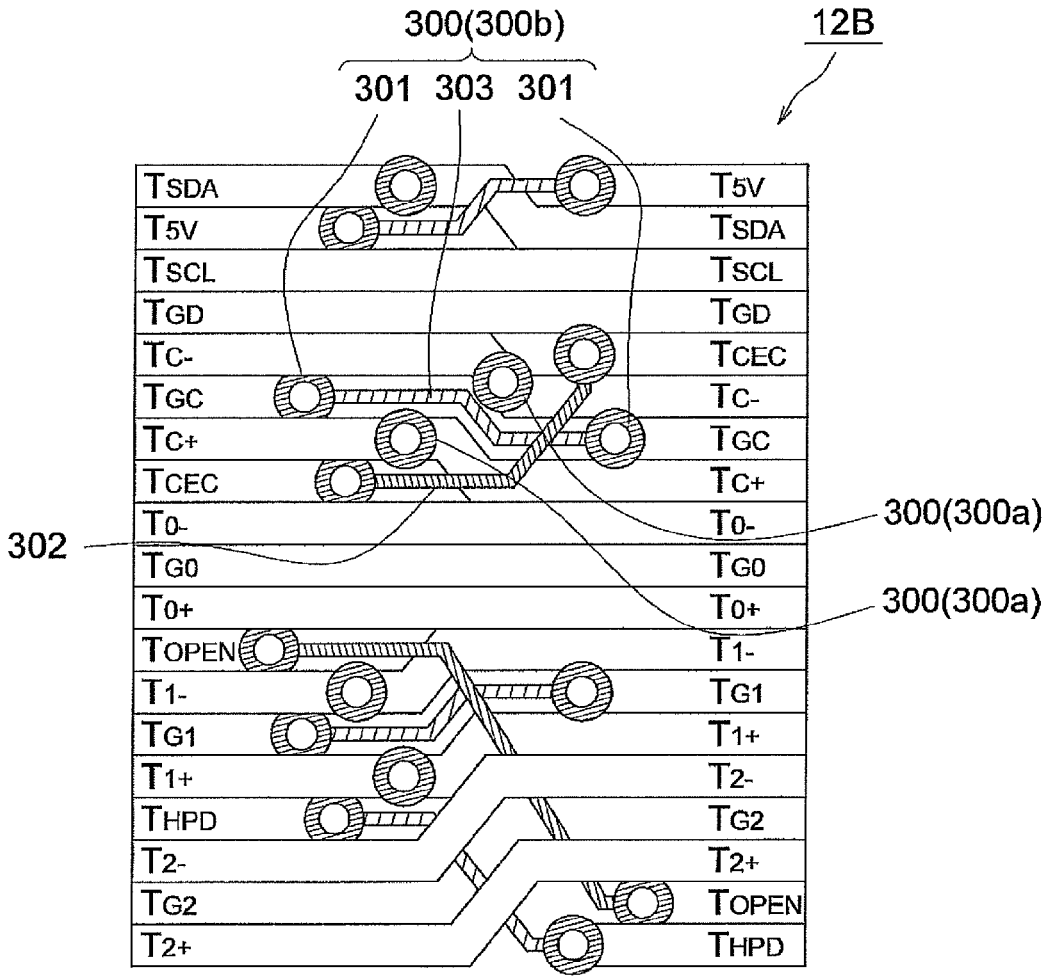
FIG. 18 is a see-through plan view illustrating a terminal insulation plate 12C according to the third embodiment as viewed from a second primary surface $S_2$ side.

The configuration of the receptacle 12 according to the third embodiment will be described with reference to the drawings. FIG. 16 is a perspective view illustrating the receptacle 12 according to the third embodiment as viewed from the second primary surface $S_2$ side. FIG. 17 is a see-through perspective view illustrating the terminal insulation plate 12C as viewed from the second primary surface $S_2$ side. FIG. 18 is a see-through plan view illustrating the terminal insulation plate 12C as viewed from the second primary surface $S_2$ side. The casing of the receptacle 12 has been omitted from FIGS. 16 to 18.

As shown in FIG. 16, the terminal insulation plate 12C is configured of three substrates that are stacked (a top substrate 121, a middle substrate 122, and a bottom substrate 123).

As shown in FIG. 17, the vertical positions of the ground terminal $T_{GC}$ and the pair of signal terminals $T_{C+}$ and $T_{C-}$ are inverted within the terminal insulation plate 12C.

As shown in FIG. 18, the multiple terminals 12B have multiple internal layer portions 300. Each internal layer portion 300 passes through the terminal insulation plate 12C from the first primary surface $S_1$ to the second primary surface $S_2$. Each inner layer portion 300 is configured of at least one of a via wire 301, an internal layer wire 302, and an internal layer wire 303.

The via wire 301 is formed by plating the inner wall of a via hole that passes through at least one of the top substrate 121, the middle substrate 122, and the bottom substrate 123 with a conductive material.

The internal layer wire 302 is formed between the top substrate 121 and the middle substrate 122. The internal layer wire 302 is connected to two via wires 301.

The internal layer wire 303 is formed between the middle substrate 122 and the bottom substrate 123. The internal layer wire 303 is connected to two via wires 301.

Figure 19:
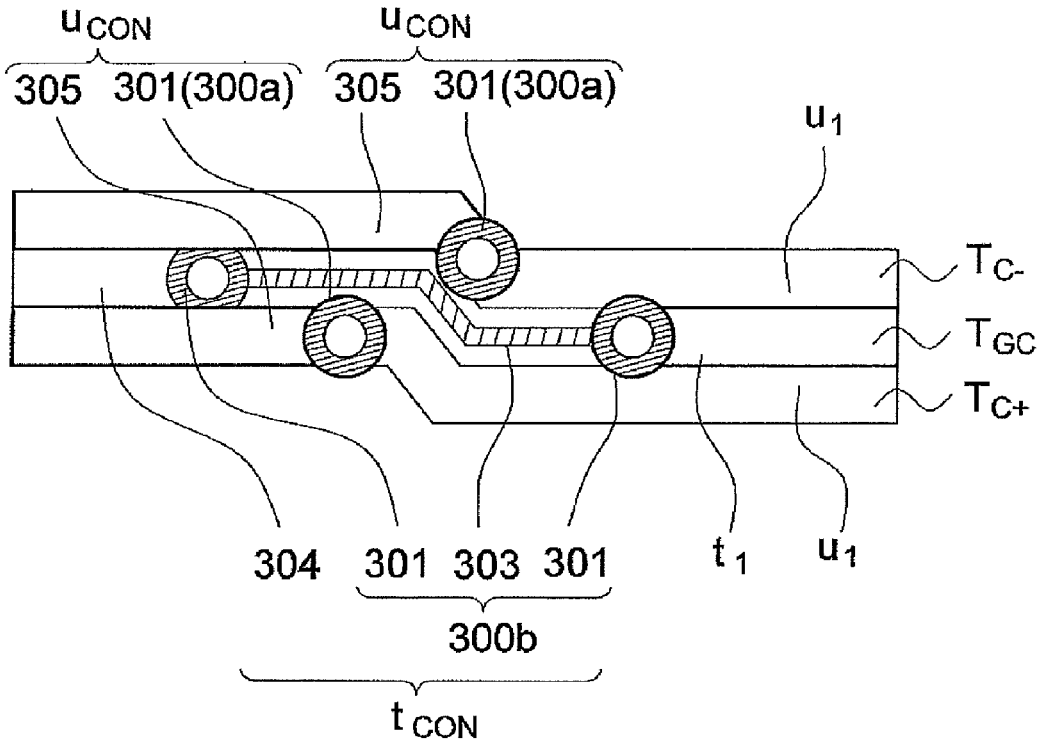
FIG. 19 is an enlarged view of FIG. 18.

Here, FIG. 19 is an enlarged view of FIG. 18. FIG. 19 illustrates the configuration of the ground terminal $T_{GC}$ and the pair of signal terminals $T_{C+}$ and $T_{C-}$.

As shown in FIG. 19, the ground terminal $T_{GC}$ has a first ground terminal end portion $t_1$ and a ground terminal link portion $t_{CON}$.

In the present embodiment, the ground terminal link portion $t_{CON}$ includes two via wires 301, the internal layer wire 303, and an extension portion 304. As described above, the two via wires 301 and the internal layer wire 303 correspond to the internal layer portion 300 (hereinafter called "a second internal layer portion 300*b*") according to the present embodiment. One of the via wires 301 is connected to the first ground terminal end portion $t_1$ on the second primary surface $S_2$. The extension portion 304 is connected to the top of the first primary surface $S_1$ of the terminal insulation plate 12C.

Meanwhile, each of the pair of signal terminals $T_{C+}$ and $T_{C-}$ has a first signal terminal end portion $u_1$ and a signal terminal link portion $u_{CON}$.

In the present embodiment, the signal terminal link portion $u_{CON}$ includes a via wire 301 and an extension portion 305. As described above, the via wire 301 corresponds to the internal layer portion 300 (hereinafter called "a first internal layer portion 300*a*") according to the present embodiment. The via wire 301 is connected to the first signal terminal end portion $u_1$ on the first primary surface $S_1$. The extension portion 305 is connected to the top of the second primary surface $S_2$ of the terminal insulation plate 12C.

(Operations and Effects)

In the receptacle 12 according to the third embodiment, the ground terminal link portion $t_{CON}$ of the ground terminal $T_{GC}$ has the second internal layer portion 300*b*. Likewise, the signal terminal link portion $u_{CON}$ of the signal terminal $T_{C+}$ has the first internal layer portion 300*a*.

Accordingly, the vertical positions of the ground terminal $T_{GC}$ and the signal terminal $T_{C+}$ are inverted within the terminal insulation plate 12C. It is thus unnecessary to cause the ground terminal $T_{GC}$ and the signal terminal $T_{C+}$ to intersect in areas where each of them does not make contact with the plate. As a result, the terminal structure can be simplified.

Other Embodiments

Although the present invention has been described according to the aforementioned embodiments, it is to be understood that the descriptions and drawings of which this disclosure is made up are not intended to limit the invention. Various alternative embodiments, working examples, and operational techniques should be clear to a person skilled in the art based on this disclosure.

For example, although the aforementioned embodiments describe an interface based on the HDMI standard as an example of an interface between electronic devices, the present invention is not limited to this interface. A serial interface based on a standard such as USB (Universal Serial Bus)®, DVI (Digital Visual Interface)®, or IEEE (Institute of Electrical and Electronic Engineers) 1394 can be used as the interface between the electronic devices.

Furthermore, although the aforementioned embodiments describe the pairs of signal terminals as transmitting signals according to a quasi-differential transmission system based on TMDS or the like, the present invention is not limited thereto. For example, the pair of signal terminals T may transmit signals according to a differential transmission system based on the USB standard.

Figure 20:
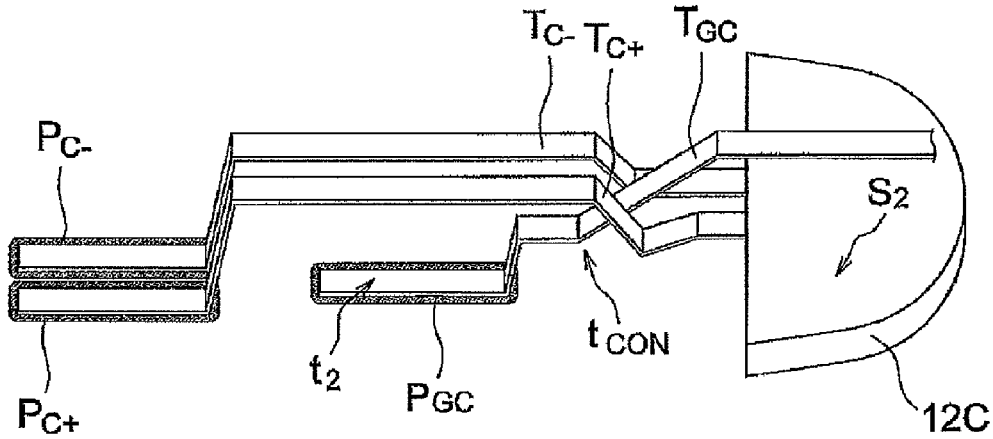
FIG. 20 is a perspective view illustrating a ground terminal $T_{GC}$ and a pair of signal terminals $T_{C+}$ and $T_{C-}$ according to an embodiment.
Figure 21:
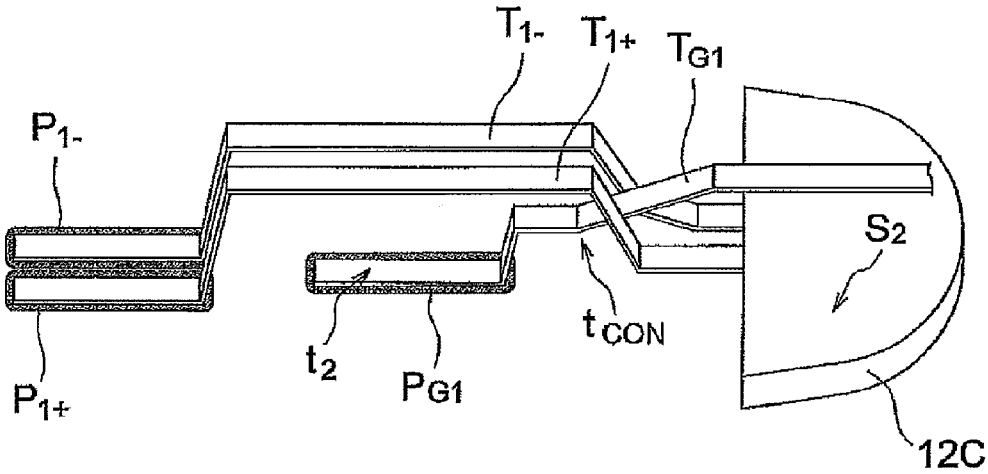
FIG. 21 is a perspective view illustrating a ground terminal $T_{G1}$ and a pair of signal terminals $T_{1+}$ and $T_{1-}$ according to an embodiment.

Furthermore, the aforementioned embodiments describe the ground terminal link portion $t_{CON}$ as passing a side of the pair of signal terminals $T_{C+}$ and $T_{C-}$, but the present invention is not limited thereto. For example, as shown in FIGS. 20 and 21, the ground terminal link portion $t_{CON}$ may pass between the signal terminal $T_{C+}$ and the signal terminal $T_{C-}$.

Furthermore, the aforementioned embodiments describe the second ground terminal end portion $t_2$ as being bent back toward the opening portion 12A, but the present invention is not limited thereto. For example, as shown in FIGS. 20 and 21, the second ground terminal end portion $t_2$ need not be bent back toward the opening portion 12A.

Furthermore, the aforementioned embodiments describe the ground terminal $T_{GC}$ and the ground terminal $T_{G1}$ as being formed at a greater width in the ground terminal link portion $t_{CON}$, but the present invention is not limited thereto. For example, as shown in FIGS. 20 and 21, the ground terminal $T_{GC}$ and the ground terminal $T_{G1}$ may be formed at a uniform line width.

Figure 22:
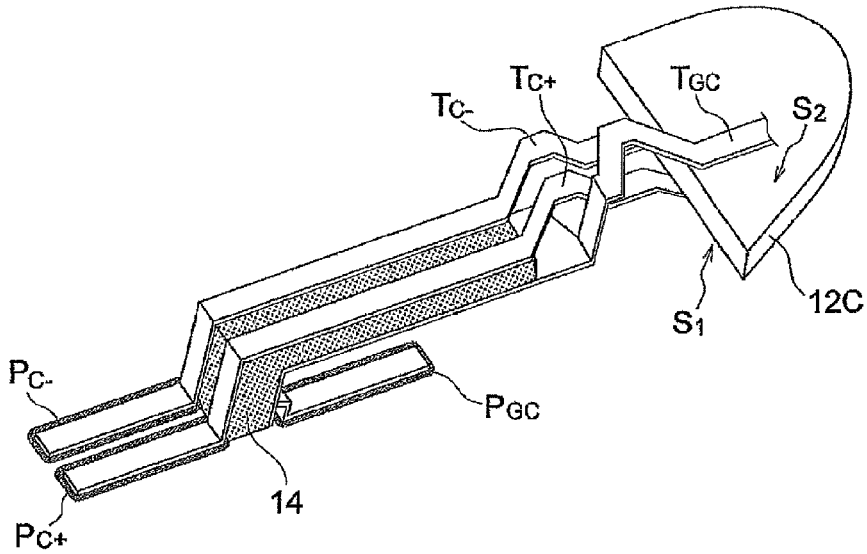
FIG. 22 is a perspective view illustrating the configuration of a dielectric element 14 according to an embodiment.
Figure 23:
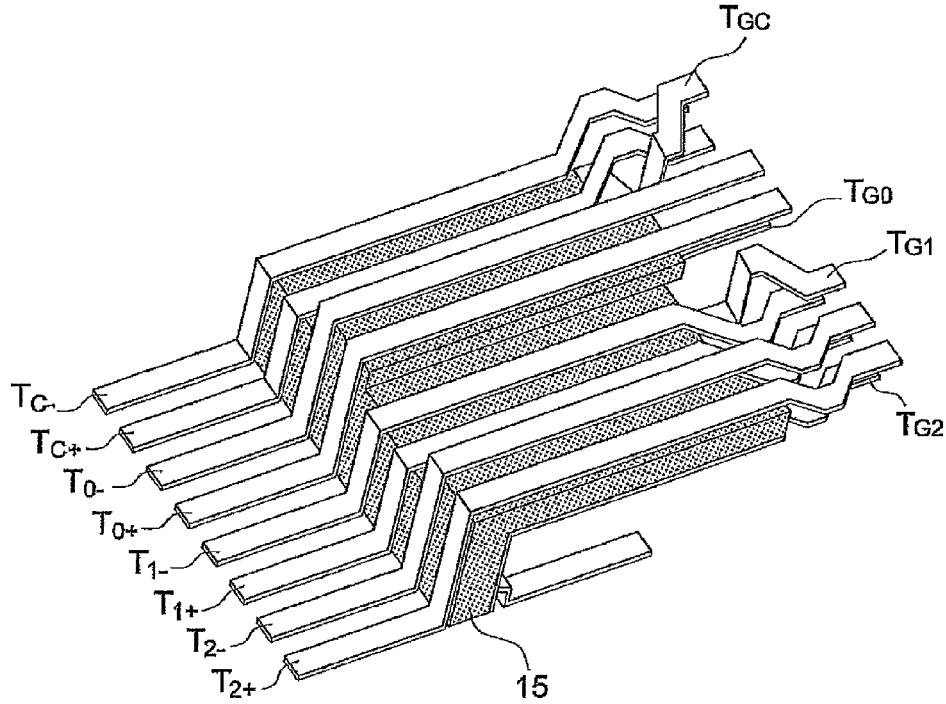
FIG. 23 is a perspective view illustrating the configuration of a dielectric element 15 according to an embodiment.

Furthermore, although not particularly discussed in the aforementioned embodiments, the receptacle 12 may include a dielectric element provided between a pair of signal terminals and a ground terminal. Specifically, as shown in FIG. 22, the receptacle 12 may include a dielectric element 14 provided between the pair of signal terminals $T_{C+}$ and $T_{C-}$ and the ground terminal $T_{GC}$. Furthermore, as shown in FIG. 23, the receptacle 12 may include a plate-shaped dielectric element 15 inserted between the pair of signal terminals $T_{C+}$ and $T_{C-}$ and the ground terminal $T_{GC}$, the pair of signal terminals $T_{0+}$ and $T_{0-}$ and the ground terminal $T_{G0}$, the pair of signal terminals $T_{1+}$ and $T_{1-}$ and the ground terminal $T_{G1}$, and the pair of signal terminals $T_{2+}$ and $T_{2-}$ and the ground terminal $T_{G2}$. The dielectric element 15 has a structure in which multiple dielectric elements 14 are linked together in an integrated manner. By adjusting the conductivity of the dielectric element 14 or the dielectric element 15, the characteristic impedance of the lines Ruined by the pairs of signal terminals and the ground terminals can be adjusted in a simple manner. Furthermore, because the pairs of signal terminals and the ground terminals are held by the dielectric element 14 or the dielectric element 15, the mechanical strength of the receptacle 12 can be increased as well.

Furthermore, although not particularly discussed in the aforementioned embodiment, the widths of the pairs of signal terminals, the widths of the ground terminals that correspond to the pairs of signal terminals, or the distances between the pairs of signal terminals and the ground terminals can be set as appropriate in order to adjust the characteristic impedance of the lines formed by the pairs of signal terminals and the ground terminals.

Thus it goes without saying that the present invention includes various other embodiments not described here. Accordingly, the technical scope of the present invention is to be defined only by the invention-defining matters according to the scope of claims pursuant to the above descriptions.

What is claimed is:

1. A receptacle configured to be mounted on a mounting surface of a printed wiring board, the receptacle comprising:

a terminal insulation plate including a first primary surface distanced from the mounting surface and a second primary surface provided on the opposite side of the mounting surface relative to the first primary surface;

a pair of signal terminals, each terminal including a first signal terminal end portion connected to the first primary surface, a second signal terminal end portion connected to the mounting surface, and a signal terminal link portion connecting the first signal terminal end portion and the second signal terminal end portion; and a ground terminal including a first ground terminal end portion connected to the second primary surface, a second ground terminal end portion connected to the mounting surface, and a ground terminal link portion connecting the first ground terminal end portion and the second ground terminal end portion, a part of the ground terminal link portion being disposed between the signal terminal link portions and the mounting surface.

2. The receptacle according to claim 1, wherein the receptacle defines an interior space with an opening that is configured to receive a plug fitted with the terminal insulation plate.

3. The receptacle according to claim 2, wherein the second ground terminal end portion is disposed closer to the opening than the second signal terminal end portion.

4. The receptacle according to claim 1, wherein the ground terminal link portion passes an outer side part of the pair of signal terminals.

5. The receptacle according to claim 1, wherein the pair of signal terminals includes a first signal terminal and a second signal terminal, the ground terminal link portion passes between the first signal terminal and the second signal terminal.

6. The receptacle according to claim 1, wherein the ground terminal link portion is arranged along the signal terminal link portions.

7. The receptacle according to claim 5, wherein the receptacle defines an interior space with an opening that is configured to receive a plug fitted with the terminal insulation plate.

8. The receptacle according to claim 6, wherein the second ground terminal end portion is bent backwards towards the opening.

9. The receptacle according to claim 1, wherein when viewed from the mounting surface side, the width of at least part of the ground terminal link portion is greater than the width of the first ground terminal end portion.

10. The receptacle according to claim 7, wherein at least part of the signal terminal link portion covers a mounting surface side of the pair of signal terminals.

11. The receptacle according to claim 1, wherein the pair of signal terminals is configured to transmit signals according to a differential transmission system or a quasi-differential transmission system.

12. The receptacle according to claim 1, further comprising a dielectric element disposed between the signal terminal link portions and the ground terminal link portion.

13. The receptacle according to claim 1, wherein each terminal includes a wide portion and a narrow portion connecting to the wide portion to the first signal terminal end portion, the narrow portion is smaller than the wide portion when viewed from above, and the ground terminal link portion is disposed between the narrow portions of the pair of signal terminals.

14. The receptacle according to claim 1, wherein each of the signal terminal link portions includes a first internal layer portion connected to the first signal terminal end portion on the first primary surface, the first internal layer portion passing through the terminal insulation plate from the first primary surface to the second primary surface.

15. The receptacle according to claim 14, wherein the ground terminal link portion includes a second internal layer portion connected to the first ground terminal end portion on the second primary surface, the second internal layer portion passing through the terminal insulation plate from the second primary surface to the first primary surface.

16. An electronic device comprising:

a printed wiring board with a mounting surface and a receptacle mounted on the printed wiring board, the receptacle including a terminal insulation plate having a first primary surface and a second primary surface, the first primary surface being disposed between the second primary surface and the mounting surface, the second primary surface being disposed a distance from the mounting surface, a pair of signal terminals, each terminal having a first signal terminal end portion connected to the first primary surface, a second signal terminal end portion connected to the mounting surface, and a signal terminal link portion connecting the first signal terminal end portion to the second signal terminal end portion, a ground terminal having a first ground terminal end portion connected to the second primary surface, a second ground terminal end portion connected to the mounting surface, and a ground terminal link portion connecting the first ground terminal end portion to the second ground terminal end portion, a part of the ground terminal link portion being disposed between the signal terminal link portions and the mounting surface, the receptacle defining an interior space with an opening configured to receive a plug fitted with the terminal insulation plate, and the printed wiring board including a first connection region disposed a distance from the opening when viewed from the mounting surface side, first connection region being connected to the second signal terminal end portion, and a second connection region disposed between the first connection region and the opening when viewed from the mounting surface side, the second connection region being connected to the second ground terminal end portion.

* * * * *